US008263302B2

(12) United States Patent
Moriya et al.

(10) Patent No.: US 8,263,302 B2
(45) Date of Patent: Sep. 11, 2012

(54) CARRIER FOR ELECTROPHOTOGRAPHY AND TWO-COMPONENT DEVELOPER

(75) Inventors: Yoshihiro Moriya, Shizuoka-ken (JP); Akihiro Kotsugai, Shizuoka-ken (JP); Toyoshi Sawada, Kanagawa-ken (JP); Ryota Inoue, Shizuoka-ken (JP); Akiyoshi Sabu, Shizuoka-ken (JP); Shingo Sakashita, Shizuoka-ken (JP)

(73) Assignee: Ricoh Company, Ltd., Tokyo (JP)

( * ) Notice: Subject to any disclaimer, the term of this patent is extended or adjusted under 35 U.S.C. 154(b) by 451 days.

(21) Appl. No.: 12/555,109

(22) Filed: Sep. 8, 2009

(65) Prior Publication Data

US 2010/0061759 A1 Mar. 11, 2010

(30) Foreign Application Priority Data

Sep. 11, 2008 (JP) ..... 2008-233831

(51) Int. Cl.
*G03G 9/00* (2006.01)

(52) U.S. Cl. ..... 430/111.35; 430/111.1; 430/111.3; 430/111.31; 430/111.32

(58) Field of Classification Search ..... 430/111.1, 430/111.3, 111.31, 111.32, 111.35
See application file for complete search history.

(56) References Cited

U.S. PATENT DOCUMENTS

| | | | | |
|---|---|---|---|---|
| 5,989,767 | A * | 11/1999 | Yoerger et al. | 430/111.32 |
| 6,287,739 | B1 * | 9/2001 | Kawakami et al. | 430/108.7 |
| 6,472,118 | B1 | 10/2002 | Yamaguchi et al. | |
| 6,489,073 | B2 | 12/2002 | Kotsugai et al. | |
| 6,599,672 | B2 | 7/2003 | Yamaguchi et al. | |
| 6,696,213 | B2 | 2/2004 | Yamaguchi et al. | |
| 6,735,409 | B2 | 5/2004 | Takahashi et al. | |
| 6,739,534 | B2 | 5/2004 | Yamaguchi et al. | |
| 6,743,558 | B2 | 6/2004 | Yamaguchi et al. | |
| 6,939,654 | B2 | 9/2005 | Kotsugai et al. | |
| 7,192,679 | B2 | 3/2007 | Yamaguchi et al. | |
| 7,320,852 | B2 | 1/2008 | Kotsugai et al. | |
| 2003/0186147 | A1 * | 10/2003 | Pickering et al. | 430/97 |
| 2008/0280224 | A1 | 11/2008 | Inoue et al. | |
| 2009/0186292 | A1 | 7/2009 | Inoue et al. | |

FOREIGN PATENT DOCUMENTS

| | | |
|---|---|---|
| JP | 54-155048 | 12/1979 |
| JP | 57-40267 | 3/1982 |
| JP | 58-108548 | 6/1983 |
| JP | 58-108549 | 6/1983 |
| JP | 59-166968 | 9/1984 |
| JP | 1-19584 | 4/1989 |
| JP | 3-628 | 1/1991 |

(Continued)

OTHER PUBLICATIONS

Georges, Michael K., et al., "Narrow Polydispersity Polystyrene by a Free-Radical Polymerization Process—Rate Enhancement", *Macromolecules*, vol. 27, No. 24, pp. 7228-7229 (1994).

(Continued)

*Primary Examiner* — Mark F Huff
*Assistant Examiner* — Stewart Fraser
(74) *Attorney, Agent, or Firm* — Cooper & Dunham LLP

(57) ABSTRACT

A carrier for electrophotographic developer, including a core material; and a layer comprising a binder resin, located overlying the core material, wherein the binder resin includes a segment including one or more polymerizable vinyl monomers as a structural unit; and another segment including a partial cleavage structure of polyhedral oligomeric silsesquioxane and/or another partial cleavage structure of polyhedral oligomeric silsesquioxane as a structural unit.

9 Claims, 5 Drawing Sheets

FOREIGN PATENT DOCUMENTS

| | | |
|---|---|---|
| JP | 6-202381 | 7/1994 |
| JP | 8-6307 | 1/1996 |
| JP | 9-160304 | 6/1997 |
| JP | 2683624 | 8/1997 |
| JP | 3120460 | 10/2000 |
| JP | 2002-80523 | 3/2002 |
| JP | 2005-320519 | 11/2005 |
| JP | 2006-58811 | 3/2006 |
| JP | 3808120 | 5/2006 |
| JP | 3973313 | 6/2007 |

OTHER PUBLICATIONS

Matyjaszewski, Krzysztof, et al., "Atom Transfer Radical Polymerization", *Chemical Reviews*, vol. 101, No. 9, pp. 2921-2990 (2001).

Wayland, Bradford B., et al., "Living Radical Polymerization of Acrylates by Organocobalt Porphyrin Complexes", *Journal of the American Chemical Society*, vol. 116, No. 17, pp. 7943-7944 (1994).

* cited by examiner

CARRIER FOR ELECTROPHOTOGRAPHY AND TWO-COMPONENT DEVELOPER

BACKGROUND OF THE INVENTION

1. Field of the Invention

The present invention relates to a carrier for electrophotography and a two-component developer.

2. Discussion of the Related Art

As image forming apparatuses such as electrophotographic copiers, two-component image developers using a two-component developer including magnetic carrier for developing electrostatic latent images and one-component image developers using only a toner are known.

Typically, the two-component image developers include a magnet roller formed of a magnet including plural magnetic poles and a developing sleeve as a rotatably-supported cylindrical developer bearer. On the surface of the developing sleeve, a magnetic brush is formed of the two-component developer in which a toner adhered to a carrier. The magnetic brush is transferred to a developing area of an image bearer to develop. The toner is stirred and mixed with the carrier in the two-component image developers to be charged, and toner has stable chargeability and stably produces good images.

The carrier includes a core material coated with a resin materials in many cases for the purpose of preventing a toner from being spent on the surface of a carrier, forming a uniform surface of the carrier, preventing the surface from being oxidize, preventing deterioration of moisture sensitivity of the carrier, extending the life of a developer, preventing the carrier from adhering to the surface of a photoreceptor, protecting a photoreceptor from being scratched or abraded with the carrier, controlling the charge polarity or adjusting charge quantity, etc. As a carrier having a core material coated with a resin, Japanese published unexamined application No. 58-108548 discloses a carrier having a core material coated with a specific resin material; Japanese published unexamined applications Nos. 54-155048, 57-40267, 58-108549, 59-166968 and 6-202381, and Japanese published examined applications Nos. 1-19584 and 3-628 disclose carriers having core materials coated with resins including various additives; Japanese Patent No. 3120460 discloses a carrier, the surface of which an additive adheres to; Japanese published unexamined application No. 9-160304 discloses a carrier whose resin-coated core material has a coated layer including an electroconductive particulate material larger than the thickness of the layer; etc.

Japanese published unexamined application No. 8-6307 discloses a carrier having a core material coated with a resin including a benzoguanamine-n-butylalcohol-formaldehyde copolymer as a main component. Japanese Patent No. 2683624 discloses a carrier having a core material is coated with a cross-linked material of a melamine resin with an acrylic resin.

However, these carriers have insufficient durability and are insufficiently prevented to adhere to a photoreceptor. Particularly, the toner spent on the surface of a carrier destabilizes charge quantity and the abrasion of the coated layer deteriorates the resistivity of a carrier. Quality images can initially be produced, but the more produced, the lower the image quality. Therefore, the carriers need improvement.

In order to solve such problems, Japanese published unexamined application No. 2006-058811 discloses a carrier having a double-layered core material formed of an acrylic resin layer having high adhesiveness thereto and a silicone resin layer having a low surface energy and covering the acrylic resin layer.

Japanese Patents Nos. 3808120 and 3973313 disclose using an acrylic-modified silicone resins having respective good properties of an acrylic resin and a silicone resin to improve chargeability of the resultant carrier, adhesiveness to a core material thereof and resistance thereof to the toner spent.

The carriers disclosed in Japanese Patents Nos. 3808120 and 3973313 improve adhesiveness of the coated resin to a core material to prevent deterioration of image quality due to abraded layer and toner spent. However, these carriers are likely to have deteriorated coated layer due to a stress when a developer including the carrier is stirred, such as abraded layer due to insufficient mechanical strength, and have room for improvement.

Because of these reasons, a need exists for a carrier in which adhesiveness of a coated resin to a core material thereof is improved, preventing deterioration of image quality due to toner spent and having improved durability.

SUMMARY OF THE INVENTION

Accordingly, an object of the present invention is to provide a carrier in which adhesiveness of a coated resin to a core material thereof is improved, preventing deterioration of image quality due to toner spent and having improved durability.

Another object of the present invention is to provide a two-component developer using the carrier.

A further object of the present invention is to provide an image forming apparatus using the two-component developer.

Another object of the present invention is to provide process cartridge using the two-component developer.

A further object of the present invention is to provide a container containing the two-component developer.

To achieve such objects, the present invention contemplates the provision of a carrier for electrophotographic developer, comprising:

a core material; and a layer comprising a binder resin, located overlying the core material, wherein the binder resin comprises:

a segment (A) comprising one or more polymerizable vinyl monomer as a structural unit; and a segment (B) comprising at least one of a partial cleavage structure of polyhedral oligomeric silsesquioxane having the following formula (1) and a partial cleavage structure of polyhedral oligomeric silsesquioxane having the following formula (2) as a structural unit:

$$(RSiO_{1.5})_n \quad (1)$$

wherein n represents an integer not less than 4; and a substituent R represents a hydrogen atom, a halogen atom, an alkoxy group or an aryloxy group having 1 to 10 carbon atoms, a saturated hydrocarbon group having 1 to 20 carbon atoms, an alkenyl group having 2 to 20 carbon atoms, an aralkyl group having 6 to 20 carbon atoms, an aryl group having 7 to 20 carbon atoms, a hydroxyalkyl group having 1 to 20 carbon atoms, a silicon-containing group having 1 to 10 silicon atoms or their substituted groups; and $$(R^1SiO_{1.5})_n(R^2SiO_2H)_m \quad (2)$$

wherein n and m independently represent an integer not less than 2; and $R^1$ and $R^2$ independently represent a hydrogen atom, a halogen atom, an alkoxy group or an aryloxy group having 1 to 10 carbon atoms, a saturated hydrocarbon group having 1 to 20 carbon atoms, an alkenyl group having 2 to 20 carbon atoms, an aralkyl group having 6 to 20 carbon atoms, an aryl group having 7 to 20 carbon atoms, a hydroxyalkyl group having 1 to 20 carbon atoms, a silicon-containing group having 1 to 10 silicon atoms or their substituted groups.

These and other objects, features and advantages of the present invention will become apparent upon consideration of the following description of the preferred embodiments of the present invention taken in conjunction with the accompanying drawings.

DESCRIPTION OF THE PREFERRED EMBODIMENTS

Figure 1:
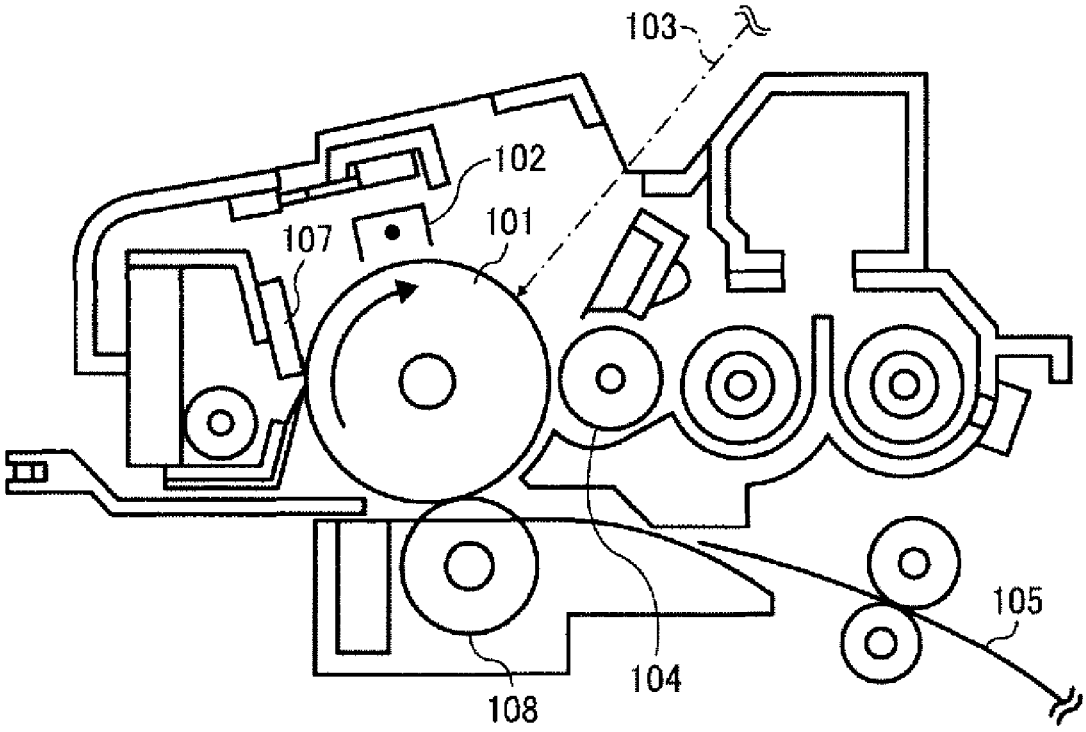
FIG. 1 is a schematic view illustrating an embodiment of the process cartridge of the present invention.

Generally, the present invention provides a carrier in which adhesiveness of a coated resin to a core material thereof is improved, preventing deterioration of image quality due to toner spent and having improved durability.

More particularly, the present invention relates to a carrier for electrophotographic developer, comprising:

a core material; and a layer comprising a binder resin, located overlying the core material, wherein the binder resin comprises:

a segment (A) comprising one or more polymerizable vinyl monomer as a structural unit; and a segment (B) comprising at least one of a partial cleavage structure of polyhedral oligomeric silsesquioxane having the following formula (1) and a partial cleavage structure of polyhedral oligomeric silsesquioxane having the following formula (2) as a structural unit:

$$(RSiO_{1.5})_n \quad (1)$$

wherein n represents an integer not less than 4; and a substituent R represents a hydrogen atom, a halogen atom, an alkoxy group or an aryloxy group having 1 to 10 carbon atoms, a saturated hydrocarbon group having 1 to 20 carbon atoms, an alkenyl group having 2 to 20 carbon atoms, an aralkyl group having 6 to 20 carbon atoms, an aryl group having 7 to 20 carbon atoms, a hydroxyalkyl group having 1 to 20 carbon atoms, a silicon-containing group having 1 to 10 silicon atoms or their substituted groups; and $$(R^1SiO_{1.5})_n(R^2SiO_2H)_m \quad (2)$$

wherein n and m independently represent an integer not less than 2; and $R^1$ and $R^2$ independently represent a hydrogen atom, a halogen atom, an alkoxy group or an aryloxy group having 1 to 10 carbon atoms, a saturated hydrocarbon group having 1 to 20 carbon atoms, an alkenyl group having 2 to 20 carbon atoms, an aralkyl group having 6 to 20 carbon atoms, an aryl group having 7 to 20 carbon atoms, a hydroxyalkyl group having 1 to 20 carbon atoms, a silicon-containing group having 1 to 10 silicon atoms or their substituted groups.

The carrier of the present invention has at least a core material and a layer coated on the surface of the core material, and may optionally have other constitutions. Hereinafter, the respective constitutions will be explained.

<Core Material>

The core material is not particularly limited if its is a magnetic particulate material, and can suitably be selected in accordance with the purposes. For example, ferrite, magnetite, iron, etc. are preferably used. Particularly, the ferrite is more preferably used.

Specific examples of the ferrite include manganese-ferrite, manganese-magnesium ferrite, manganese-strontium ferrite, manganese-magnesium-strontium ferrite, Cu—Zn ferrite, lithium ferrite, etc.

For the purpose of controlling the core material resistance and improving producibility of the ferrite, one or more of constituent elements such as Li, Na, K, Ca, Ba, Y, Ti, Zr, V, Ag, Ni, Cu, Zn, Al, Sn, Sb and Bi can be added thereto. The content of the constituent elements is preferably not greater than 5%, and more preferably not greater than 3% by atomic weight based on total atomic weight of the metals included in the carrier.

The average particle diameter of the core material is not particularly limited, and can suitably be selected in accordance with the purposes. The core material preferably has a volume-average particle diameter of from 10 to 200 μm, and more preferably from 10 to 60 μm. The volume-average particle diameter thereof can be measured by SRA type of MICROTRAC particle size analyzer measuring a range of from 0.7 to 125 μm from NIKKISO CO., LTD.

<Coated Layer>

The coated layer includes at least a binder resin, and may optionally include other components such as a particulate material.

Binder Resin

The binder resin includes a segment (A) including one or more polymerizable vinyl monomer as a structural unit and a segment (B) including at least one of a partial cleavage structure of polyhedral oligomeric silsesquioxane and/or another partial cleavage structure of polyhedral oligomeric silsesquioxane as a structural unit.

Segment (A)

Specific examples of the polymerizable vinyl monomer forming the segment (A) are not particularly limited and can suitably selected in accordance with the purposes, and include acrylic acid esters such as methylacrylate, ethylacrylate, butylacrylate, isobutylacrylate, 2-ethylhexylacrylate, heptylacrylate, dodecylacrylate, 2-hydroxyethylacrylate, 3-chloro-s-hydroxypropylacrylate, glycerin monoacrylic acid ester and N-methylolacrylamide; methacrylic acid esters such as methylmethacrylate, ethylmethacrylate, sec-butylmethacrylate, tert-butylmethacrylate, cyclohexylmethacrylate, dodecylmethacrylate, 2-ethylhexylmethacrylate, 2-hydroxyethylmethacrylate, 3-chloro-s-hydroxypropylmethacrylate, diethyleneglycolmonomethacrylic acid ester, glycerin monomethacrylic acid ester and N-methylolmethacrylamide; acrylic acid; methacrylic acid; itaconic acid; crotonic acid, fumaric acid, maleic acid; maleic acid anhydride; etc. These polymerizable vinyl monomers may form the segment (A) in the form of a homopolymer or a copolymer.

The segment (A) formed of a polymerizable vinyl monomer, particularly an acrylic resin skeleton, has firm adhesiveness with a particulate material included in the core material and the coated layer. The segment (A) strongly prevents the coated layer from peeling off from the core material and being abraded, and stably protects the coated layer. The acrylic resin skeleton can firmly hold the core material and a particulate material such as an electroconductive particulate material included in the coated layer with strong adhesiveness. Particularly, the acrylic resin skeleton strongly holds a particulate material having a particle diameter larger than the thickness of the coated layer.

The segment (A) further cross-linked with an amino resin or an isocyanate compound can prevent the resins from fusion bonding to each other likely to occur when an acrylic resin is solely used, i.e., blocking while maintaining suitable elasticity. Then, the segment (A) can introduce a hydroxyl group which is a cross-linking point with amino resin the to the segment (A) skeleton when copolymerized with one or more polymerizable vinyl monomers having a hydroxyl group.

Specific examples of the amino resins are not particularly limited and include known amino resin in accordance with the purposes, and guanamine resins and melamine resins are preferably used to improve the chargeability of a carrier. At least the guanamine resins or melamine resins with other amino resins may be used to suitably control the chargeability of a carrier.

Specific examples of the isocyanate compounds include polyisocyanates such as tolylenediisocyanate, diphenylmethanediisocyanate, triphenylmethanetriisocyanate, polyphenylmethanepolyisocyanate, modified diphenylmethanediisocyanate (modified MDI), hydrogenated xylylenediisocyanate (H-XDI), xylylenediisocyanate (XDI), hexamethylenediisocyanate, (HMDI), trimethylhexamethylenediisocyanate (TMHMDI), tetramethylxylylenediisocyanate (m-TMXDI), isophoronediisocyanate (IPDI), norbornenediisocyanate (NBDI), 1,3-bis(isocyanatemethyl) cyclohexane (H6XDI) and 1,5-naphthalenedisocyanate; or their trimeric compounds and their reaction products with polyols; etc. These isocyanate compounds may be used alone or in combination. Further, block isocyanates in which a part or all of isocyanate groups are blocked with known blockers such as phenol compounds or oximes may be used.

Segment (B)

The segment (B) has a partial cleavage structure of polyhedral oligomeric silsesquioxane having the following formula (1) and/or a partial cleavage structure of polyhedral oligomeric silsesquioxane having the following formula (2) as a structural unit:

$$(RSiO_{1.5})_n \quad (1)$$

wherein n represents an integer not less than 4; and a substituent R represents a hydrogen atom, a halogen atom, an alkoxy group or an aryloxy group having 1 to 10 carbon atoms, a saturated hydrocarbon group having 1 to 20 carbon atoms, an alkenyl group having 2 to 20 carbon atoms, an aralkyl group having 6 to 20 carbon atoms, an aryl group having 7 to 20 carbon atoms or a silicon-containing group having 1 to 10 silicon atoms; and $$(R^1SiO_{1.5})_n\,(R^2SiO_2H)_m \quad (2)$$

wherein n and m independently represent an integer not less than 2; and $R^1$ and $R^2$ independently represent a hydrogen atom, a halogen atom, an alkoxy group or an aryloxy group having 1 to 10 carbon atoms, a saturated hydrocarbon group having 1 to 20 carbon atoms, an alkenyl group having 2 to 20 carbon atoms, an aralkyl group having 6 to 20 carbon atoms, an aryl group having 7 to 20 carbon atoms or a silicon-containing group having 1 to 10 silicon atoms.

The silsesquioxane typically means a polysiloxane compound constituted of T-unit siloxane, represented by $RSiO_{3/2}$ from sesqui (3/2). Amorphous, ladder-shaped, basket-shaped or their partial cleavage structured silsesquioxane are known as constitutional units. The polyhedral oligomeric silsesquioxane can be synthesized by, e.g., a method disclosed in Japanese published unexamined application No. 2004-143449. The polyhedral oligomeric silsesquioxane compound includes the polyhedral oligomeric silsesquioxane or its derivatives.

The polyhedral oligomeric silsesquioxane compound has a functional group reactable with at least a binder resin or a monomer forming the binder resin as mentioned later. At a site of the functional group, the polyhedral oligomeric silsesquioxane compound is chemically bonded with at least the binder resin or the monomer forming the binder resin.

Binding of Segment (A) with Segment (B)

Methods of forming a chemical bonding of an acrylic resin with the polyhedral oligomeric silsesquioxane compound include, e.g., a polymerization method of polymerizing an acrylic monomer to form a polymer chain with the polyhedral oligomeric silsesquioxane compound or the polyhedral oligomeric silsesquioxane partial cleavage structure having the formulae (1) and/or (2) having a functional group polymerizable with an acrylic monomer as a polymerization initiator. The polymerization methods chemically and firmly combines the vinyl polymer skeleton with the polyhedral oligomeric silsesquioxane to form a binder resin having a desired strength. Thus, the segment (A) and the segment (B) are chemically bonded with each other to form a binder resin and the resultant coated layer has good abrasion resistance and toner spent resistance.

Mw/Mn of Binder Resin

The binder resin preferably has a polydispersity determined from styrene-converted molecular weight distribution using GPC (Gel Permeation Chromatography) not greater than 3.0. The polydispersity is an index representing a molecular weight distribution of the binder resin. When greater than 3.0, the molecular weight distribution is so wide that high and low molecular weight components increase, resulting in complexity of the above-mentioned problems.

Further, the binder resin preferably has a weight-average molecular weight of from 2,000 to 200,000. When less than 20,000, the coated layer does not have sufficient strength and deteriorates in its abrasion resistance, and toner components are occasionally fusion-bonded on the coated layer of a carrier in a developer. When greater than 200,000, the resin solution increases in its viscosity when coated on a core material and is occasionally difficult to evenly coat the core material.

Living Radical Polymerization Method

Methods of forming the binder resin having such a molecular weight and a polydispersity are not particularly limited, but a living radical polymerization method of polymerizing the segment (A) with the segment (B) as a polymerization initiator is preferably used. The living radical polymerization method is a radical polymerization without losing activity of polymerization reaction at the end of a reaction product. Specific examples thereof include a method of using a cobalt porphyrin complex disclosed on page 7,943 in vol. 116 of J. Am. Chem. Soc. published in 1994; a method of using a radical capping agent of a nitroxide compound disclosed on page 7,228 in vol. 27 of Macromolecules published in 1994; an atom transfer radical polymerization (ATRP) method of polymerizing with an organic halogenated compound as an initiator and a transition metal complex as a catalyst disclosed in Japanese published unexamined applications Nos. 2005-320519 and 2002-80523; etc.

These living radical polymerization methods have an advantage of being capable of introducing a monomer having a specific functional group to a controlled site such as an end of a polymer chain, compared with conventional free radical polymerization methods of simply copolymerizing plural monomers. A binder resin for use in the carrier of the present invention is preferably prepared by the ATRP method among the living radical polymerization methods. As disclosed on page 2,921 in vol. 101 of Chem. Rev. published in 2001, the ATRP method of growing radical polymerizable monomers such as acrylic monomers and styrene monomers under the presence of metallic salts and amine compounds with an α-haloester group as an initiating group. The ATRP method can easily control a molecular weight, a molecular weight distribution (polydispersity) and a block copolymerization of an organic polymer.

The living radical polymerization method has less deactivation on the way of polymerization, can prepare a polymer having a narrow molecular weight distribution (small polydispersity) and freely control a molecular weight thereof with a ratio between a monomer and an initiator. The living radical polymerization method can provide a binder resin most suitable for a coated layer of the carrier of the present invention, having a narrow molecular weight distribution, lowering viscosity of the layer coating liquid, and capable of controlling the molecular weight, site and quantity of the constituted monomers. The conventional radical polymerization methods are free radical polymerizations only preparing a polymer having a wide molecular weight distribution, a large polydispersity and high viscosity. Further, a monomer having a desired functional group is only introduced to the polymer by chance, and a copolymer having a desired ratio is difficult to prepare.

Aminosilane Coupling Agent

The coated layer of the carrier of the present invention can further include an aminosilane coupling agent for the purpose of controlling charge quantity thereof to a toner. Known aminosilane coupling agents can be used, e.g., compounds having the following formulae are preferably used.

| | |
|---|---|
| $H_2N(CH_2)_3Si(OCH_3)_3$ | Mw 179.3 |
| $H_2N(CH_2)_3Si(OC_2H_5)_3$ | Mw 221.4 |
| $H_2N(CH_2)_3Si(CH_3)_2(OC_2H_5)$ | Mw 161.3 |
| $H_2N(CH_2)_3Si(CH_3)(OC_2H_5)_2$ | Mw 191.3 |
| $H_2N(CH_2)_2NHCH_2Si(OCH_3)_3$ | Mw 194.3 |
| $H_2N(CH_2)_2NH(CH_2)_3Si(CH_3)_2(OCH_3)$ | Mw 206.4 |
| $H_2N(CH_2)_2NH(CH_2)_3Si(OCH_3)_3$ | Mw 224.4 |
| $(CH_3)_2N(CH_2)_3Si(CH_3)(OC_2H_5)_2$ | Mw 219.4 |
| $(C4H_9)_2NC_3H_6)_3Si(OCH_3)_3$ | Mw 291.6 |

The aminosilane coupling agent may be included in a resin solution for forming a coated layer.

The aminosilane coupling agent is preferably included in the coated layer in an amount of from 0.001 to 30% by weight, and more preferably from 0.001 to 10% by weight. When less than 0.001% by weight, the chargeability is likely to receive an influence of the environment the yield is likely to deteriorate. When greater than 30% by weight, the coated layer is likely to be brittle and occasionally deteriorates in abrasion resistance.

Particulate Material

The coated layer may further include a particulate material different from resins. The particulate material can noticeably improves the strength of the coated layer when the content and particle diameter thereof are suitably selected relative to the thickness of the coated layer. Specific examples thereof include known materials such as particulate silica, titanium oxide and alumina which can be used alone or in combination. Particularly, the particulate alumina is preferably used to negatively charge a toner.

The coated layer preferably includes the particulate material in an amount of from 1 to 70% by weight, and more preferably from 18 to 50% by weight although depending on materials forming the coated layer. When less than 1% by weight, the strength of the coated layer is not sufficiently improved on occasion. When greater than 70% by weight, the particulate material is likely to leave from the coated layer, resulting in poor durability occasionally.

The coated layer may include an electroconductive material to adjust the electric resistance of the carrier. Specific examples of the electroconductive material include known electroconductive materials include metallic powders of electroconductive ZnO, Al, etc.; $SnO_2$ formed by various methods and of doped various elements; borides such as $TiB_2$, $ZnB_2$ and $MoB_2$; silicon carbonates; electroconductive polymers such as polyacetylene, polyparaphenylene, poly(para-phenylenesulfide) and polypyrrol; etc.

Formation of Coated Layer

Methods of forming a coated layer are not particularly limited and known methods of forming coated layer can be used. Specific examples thereof include spray methods or dip coating methods of coating a coated layer coating liquid where the above-mentioned materials for the coated layer such as a binder resin or a binder resin precursor are dissolved on the surface of the core material. The coated layer coating liquid is coated on the surface of the core material to form a carrier, and the carrier is preferably heated to promote polymerization reaction of the binder resin or a binder resin precursor.

The carrier may be heated in a coated layer former following to the formation of the coated layer or by other heaters such as a conventional electric oven and a firing kiln after the coated layer is formed. The carrier is preferably heated at 120 to 350° C. although depending on the coated layer materials, and the maximum temperature is preferably about 220° C. which is not higher than a decomposition temperature of the coated layer. The carrier is preferably heated for 5 to 120 min.

(Two-Component Developer)

The two-component developer of the present invention includes the above-mentioned carrier of the present invention and a toner. This prevents the carrier from adhering to a photoreceptor and is a developer for electrophotography producing high quality electrophotographic images. The two-component developer of the present invention preferably includes a toner of from 2.0 to 12.0 parts by weight, and more preferably from 2.5 to 10 parts by weight per 100 parts by weight of the carrier.

<Toner>

A toner for the two-component developer of the present invention is not particularly limited, and can be properly selected from toners used for electrophotography in accordance with the purposes. The toner typically includes at least a binder resin and a colorant, and optionally a release agent, a charge controlling agent and other components when needed.

Binder Resin

Specific examples of the binder resin include any known resins such as homopolymers of styrene and its derivatives such as polystyrene, poly-p-chlorostyrene and polyvinyltoluene; copolymers of styrene such as a styrene-p-chlorostyrene copolymer, a styrene-propylene copolymer, a styrene-vinyltoluene copolymer, a styrene-methyl acrylate copolymer, a styrene-ethyl acrylate copolymer, a styrene-methacrylic acid copolymer, a styrene-methyl methacrylate copolymer, a styrene-ethyl methacrylate copolymer, a styrene-butyl methacrylate copolymer, a styrene-α-chloro methyl methacrylate copolymer, a styrene-acrylonitrile copolymer, styrene-vinyl methyl ether copolymer, a styrene-vinyl methyl ketone copolymer, a styrene-butadiene copolymer, styrene-isoprene copolymer, a styrene-maleate copolymer; a polymethyl methacrylate resin, a polybutyl methacrylate resin, a polyvinylchloride resin, a polyethylene resin, a polyester resin, a polyurethane resin, an epoxy resin, a polyvinylbutyral resin, a polyacrylic acid resin, a rosin resin, a modified rosin resin, a terpene resin, a phenol resin, an aliphatic or aromatic hydrocarbon resin, an aromatic petroleum resin, etc. These can be used alone or in combination.

Colorant

Specific examples of the colorants for use in the present invention include any known dyes and pigments such as carbon black, Nigrosine dyes, black iron oxide, NAPHTHOL YELLOW S, HANSA YELLOW (10G, 5G and G), Cadmium Yellow, yellow iron oxide, loess, chrome yellow, Titan Yellow, polyazo yellow, Oil Yellow, HANSA YELLOW (GR, A, RN and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, redironoxide, redlead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, lithopone and the like. These materials are used alone or in combination.

A toner preferably includes a colorant in an amount of from 1 to 15% by weight, and more preferably from 3 to 10% by weight.

The colorant may be used as a masterbatch pigment combined with a resin. Specific examples of the resin include, but are not limited to, styrene polymers or substituted styrene polymers, styrene copolymers, a polymethyl methacrylate resin, a polybutylmethacrylate resin, a polyvinyl chloride resin, a polyvinyl acetate resin, a polyethylene resin, a polypropylene resin, a polyester resin, an epoxy resin, an epoxy polyol resin, a polyurethane resin, a polyamide resin, a polyvinyl butyral resin, an acrylic resin, rosin, modified rosins, a terpene resin, an aliphatic or an alicyclic hydrocarbon resin, an aromatic petroleum resin, chlorinated paraffin, paraffin waxes, etc. These resins are used alone or in combination.

Release Agent

The release agent is not particularly limited, and can be properly selected from known release agents, e.g., waxes are preferably used as the release agent. Specific examples of the wax include known waxes, e.g., polyolefin waxes such as polyethylene wax and polypropylene wax; long chain carbon hydrides such as paraffin wax and sasol wax; and waxes including carbonyl groups. Among these waxes, the waxes including carbonyl groups are preferably used.

Specific examples thereof include polyesteralkanate such as carnauba wax, montan wax, trimethylolpropanetribehenate, pentaelislitholtetrabehenate, pentaelislitholdiacetatedibehenate, glycerinetribehenate and 1,18-octadecanedioldistearate; polyalkanolesters such as tristearyltrimellitate and distearylmaleate; polyamidealkanate such as ethylenediaminebehenylamide; polyalkylamide such as tristearylamidetrimellitate; and dialkylketone such as distearylketone. Among these waxes including a carbonyl group, polyesteralkanate is preferably used.

The wax for use in the present invention usually has a melting point of from 40 to 160° C., preferably of from 50 to 120° C., and more preferably of from 60 to 90° C. A wax having a melting point less than 40° C. has an adverse effect on its high temperature preservability, and a wax having a melting point greater than 160° C. tends to cause cold offset of the resultant toner when fixed at a low temperature.

The wax preferably has a melting viscosity of from 5 to 1,000 cps, and more preferably of from 10 to 100 cps when measured at a temperature higher than the melting point by 20° C. A wax having a melting viscosity greater than 1,000 cps makes it difficult to improve hot offset resistance and low temperature fixability of the resultant toner.

The toner preferably includes a wax in an amount of from 1 to 40% by weight, and more preferably from 3 to 30% by weight. When greater than 40% by weight, the resultant toner possibly deteriorates in fluidity.

Charge Controlling Agent

Any known positive or negative charge controlling agents can be used according to the polarity of a photoreceptor.

Specific examples of the negative charge controlling agents include resins and compounds having an electron-donating group, azo dyes, metal complexes of organic acids, etc. Specific examples of the marketed products of the negative charge controlling agents include BONTRON S-31, S-32, S-34, S-36, S-37, S-39, S-40, S-44, E-81, E-82, E-84, E-86, E-88, A, 1-A, 2-A and 3-A (from Orient Chemical Industries, Ltd.); KAYACHARGE N-1 and N-2, KAYASET BLACK T-2 and 004 (from Nippon Kayaku Co., Ltd.); AIZENSPIRON BLACK T-37, T-77, T-95, TRH and TNS-2 (from Hodogaya Chemical Co., Ltd.); FCA-1001-N, FCA-1001-NB and FCA-1001-NZ (from Fujikura Kasei Co., Ltd.); etc.

Specific examples of the positive charge controlling agents include basic compounds such as nigrosine dye, cationic compounds such as quaternary ammonium salts, metal salts of higher fatty acids, etc. Specific examples of the marketed products of the positive charge controlling agents include BONTRON N-01, N-02, N-03, N-04, N-05, N-07, N-09, N-10, N-11, N-13, P-51, P-52 and AFP-B (from Orient Chemical Industries, Ltd.); TP-302, TP-415 and TP-4040 (from Hodogaya Chemical Co., Ltd.); COPY BLUE PR, COPY CHARGE PX-VP-435 and NX-VP-434 (from Hoechst AG); FCA 201, 201-B-1, 201-B-2, 201-B-3, 201-PB, 201-PZ and 301 (from Fujikura Kasei Co., Ltd.); PLZ 1001, 2001, 6001 and 7001 (from Shikoku Chemicals Corp.); etc.

These charge controlling agents can be used alone or in combination.

The content of the charge controlling agent is determined depending on the species of the binder resin used, and toner manufacturing method (such as dispersion method) used, and is not particularly limited. However, the content of the charge controlling agent is typically from 0.1 to 10 parts by weight, and preferably from 0.2 to 5 parts by weight, per 100 parts by weight of the binder resin included in the toner. When the content is too high, the toner has too large a charge quantity, and thereby the electrostatic force of a developing roller attracting the toner increases, resulting in deterioration of the fluidity of the toner and image density of the toner images.

Other Additives

The toner may optionally include other materials such as an inorganic particulate material, a fluidity improver, a cleanability improver, a magnetic material, a metal soap, etc. besides the binder resin, release agent, colorant and charge controlling agent.

Specific examples of the inorganic particulate material include silica, titania, alumina, cerium oxide, strontium titanate, calcium carbonate, magnesium carbonate, calcium phosphate, etc. Among these, hydrophobized silica particles treated by silicone oil or hexamethyldisilazane and surface-treated titanium oxide are more preferably used.

Specific examples of marketed products of the particulate silica include AEROSIL (130, 200V, 200CF, 300, 300CF, 380, OX50, TT600, MOX80, MOX170, COK84, RX200, RY200, R972, R974, R976, R805, R811, R812, T805, R202, VT222, RX170, RXC, RA200, RA200H, RA200HS, RM50, RY200 and REA200) from Nippon Aerosil Co., Ltd.; HDK (H20, H2000, H3004, H2000/4, H2050EP, H2015EP, H3050EP and KHD50, and HVK2150) from Wacker Chemie AG; CAB-O-SIL® (L-90, LM-130, LM-150, M-5, PTG, MS-55, H-5, HS-5, EH-5, LM-150D, M-7D, MS-75D, TS-720, TS-610 and TS-530) from Cabot Corporation; etc.

A parent toner preferably include the inorganic particulate material in an amount of from 0.1 to 5.0 parts by weight, and preferably from 0.8 to 3.2 parts by weight.

Toner Shape and Size

The shapes and sizes of the toner are not particularly limited and can be selected in accordance with the purposes, but the toner preferably has the following average circularity, volume-average particle diameter and a ratio of the volume-average particle diameter to a number-average particle diameter (volume-average particle diameter/number-average particle diameter).

Average-Circularity

A peripheral length of a circle having a projected area equivalent to the shape of the toner is divided by a peripheral length of the actual toner particle to determine the average circularity of the toner. The average circularity is preferably from 0.900 to 0.980, and more preferably from 0.950 to 0.975. Further, the toner preferably has particles having a circularity less than 0.94 in an amount not greater than 15%.

When the average circularity is less than 0.900, the resultant toner does not have satisfactory transferability and does not produce high-quality images without scattered toner. When greater than 0.98, an image forming apparatus using blade cleaning has poor cleaning on a photoreceptor and a transfer belt. For example, when images having a large image area such as photo images are produced, untransferred toner occasionally remains on the photoreceptor, resulting in background fouling and contamination of a charging roller.

The average circularity is measured by FPIA-2100 from SYSMEX CORPORATION and an analysis software FPIA-2100 Data Processing Program for FPIA version 00-10 was used. Specifically, 0.1 to 0.5 g of the toner and 0.5 ml of a surfactant (alkylbenzenesulfonate Neogen SC-A from Dai-ichi Kogyo Seiyaku Co., Ltd.) having a concentration of 10% by weight were mixed with a micro spatel in a glass beaker having a capacity of 100 ml, and 80 ml of ion-exchange water was added to the mixture. The mixture was dispersed by an ultrasonic disperser from HONDA ELECTRONICS CO., LTD. for 3 min. The circularity of the toner was measured by FPIA-2100 until the dispersion has a concentration of from 5,000 to 15,000 pieces/μl, which is essential in terms of measurement reproducibility of the average circularity. In order to obtain the concentration, it is necessary to control added amounts of the surfactant and the toner. The amount of the surfactant depends on the hydrophobicity of the toner. When too much, bubbles cause noises. When short, the toner is not sufficiently wetted and not sufficiently dispersed. The amount of the toner depends on the particle diameter thereof. When small, the amount needs to be less. When large, the amount needs to be more. When the toner has a particle diameter of from 3 to 10 μm, the amount thereof is 0.1 to 0.5 g such that the dispersion has a concentration of from 5,000 to 15,000 pieces/μl.

Average Particle Diameter

The toner preferably has a volume-average particle diameter of from 3 to 10 μm, and more preferably from 3 to 8 μm. When less than 3 μm, the toner is fusion-bonded to the surface of a carrier when used in a two-component developer, resulting in deterioration of the chargeability of the carrier. When greater than 10 μm, the toner is difficult to produce high definition and high-quality images, and largely varies in the particle diameter when the toner is consumed and fed in the developer.

The toner preferably has a ratio of the volume-average particle diameter to a number-average particle diameter (Dn) of from 1.00 to 1.25, and more preferably of from to 1.05 to 1.25.

The volume-average particle diameter and the number-average particle diameter were measured by Multisizer III from Beckman Coulter, Inc. using an aperture of 100 μm. An analysis software Beckman Multisizer 3 Version 3.51 was used. Specifically, 0.5 g of the toner and 0.5 ml of a surfactant (alkylbenzenesulfonate Neogen SC-A from Dai-ichi Kogyo Seiyaku Co., Ltd.) having a concentration of 10% by weight were mixed with a micro spatel in a glass beaker having a capacity of 100 ml, and 80 ml of ion-exchange water was added to the mixture. The mixture was dispersed by an ultrasonic disperser W-113MK-II from HONDA ELECTRONICS CO., LTD. for 10 min. The dispersion was measure by Multisizer III using ISOTON III as a measurement solution from Beckman Coulter, Inc. The dispersion was dropped such that Multisizer III displays a concentration of 8±2%, which is essential in terms of measurement reproducibility of the particle diameter. The measurement of the particle diameter has no error within this concentration range.

Charge Quantity

Charge quantity of the toner cannot categorically be determined because of being different depending on the practical use process. However, the toner in combination with the carrier of the present invention preferably has a saturated charge quantity of from 3 to 40 μc/g, and more preferably from 5 to 30 μc/g in numerical value.

<Toner Preparation Methods>

Methods of preparing the toner are not particularly limited, and known methods such as a pulverization method; a polymerization method of directly polymerizing a monomeric composition including a specific crystalline polymer and a polymerizable monomer in an aqueous phase (a suspension polymerization method and an emulsion polymerization method); a polyaddition reaction method using a prepolymer including an isocyanate group; a method of solving with a solvent, removing the solvent and pulverizing; and a melting spray method can be used.

Pulverization Method

The pulverization method includes melting, kneading, pulverizing and classifying toner constituents to form a parent toner. A mechanical force may be applied thereto to control the shape thereof for the purpose of increasing the average circularity thereof. A HYBRIDIZER or a MECHANOFUSION can apply the mechanical force thereto.

Specifically, in the kneading process after mixing toner constituents to prepare a mixture, the mixture is contained in a kneader and then kneaded upon application of heat. Suitable kneaders include the kneaders include single-axis or double-axis continuous kneaders and batch kneaders such as roll mills. Specific examples of the kneaders include KTK double-axis extruders manufactured by Kobe Steel, Ltd., TEM extruders manufactured by Toshiba Machine Co., Ltd., double-axis extruders manufactured by KCK Co., Ltd., PCM double-axis extruders manufactured by Ikegai Corp., and KO-KNEADER manufactured by Buss AG.

In the kneading process, it is important to control the kneading conditions so as not to cut molecular chains of the binder resin in the toner. Specifically, when the mixture is kneaded at a temperature too lower than a softening point of the binder resin, the molecular chains of the binder resin tend to cut. When the kneading temperature is too high, the mixture cannot be fully dispersed.

In the pulverizing process, it is preferable that the kneaded mixture is at first crushed to prepare coarse particles (crushing step) and then the coarse particles are pulverized to prepare fine particles (pulverizing step). In the pulverizing step, a method of crashing the coarse particles against a collision plate by jet air or a method of passing the coarse particles through a narrow gap between a mechanically rotating rotor and a stator is preferably used.

In the classifying process, the pulverized mixture is classified into particles having a predetermined particle diameter. The classification is made by cyclone, decanter and centrifugal separation, etc. to remove microscopic particles. After the microscopic particles are removed, pulverized mixture is further air-classified by a centrifugal force to prepare a toner having a predetermined particle diameter.

Suspension Polymerization Method

The suspension polymerization method includes dispersing a colorant, a release agent, etc. in an oil-soluble polymerization initiator and a polymerizing monomer to prepare a dispersion; and emulsifying the dispersion in an aqueous medium including a surfactant, a solid dispersant, etc. by an emulsification method mentioned later. After polymerized, a wet treatment applying an inorganic particulate material to the resultant toner particles is performed. Before the wet treatment, the excessive surfactant is preferably washed from the toner particles.

Specific examples of the polymerizable monomer include acids such as an acrylic acid, a methacrylic acid, an α-cyanoacrylic acid, an α-cyanomethacrylic acid, an itaconic acid, a crotonic acid, a fumaric acid and a maleic acid or a maleic acid anhydride; acrylates or methacrylates having an amino group such as acrylamide, methacrylamide, diacetoneacrylamide or their methylol compounds, vinylpyridine, vinylpyrrolidone, vinylimidazole, ethyleneimine and dimethylaminoethyl methacrylate. These can induce a functional group to the surface of the toner particles.

An acid radical or basic group as a dispersant is absorbed to the surface of the toner particles to induce a functional group thereto.

The emulsification polymerization methods include emulsifying a water-soluble polymerization initiator and a polymerizing monomer in water with a surfactant to prepare a latex by conventional emulsification polymerization methods. A dispersion wherein a colorant and a release agent are dispersed is separately prepared, and the dispersion is mixed with the latex. The mixture is agglutinated to have a toner size and fusion-bonded to prepare toner particles. Then, a wet treatment applying an inorganic particulate material to the resultant toner particles is performed. Specific examples of the latex include the polymerizable monomer used in the suspension polymerization methods.

The toner is preferably prepared by dissolving or dispersing toner constituents including an active hydrogen-containing compound and a polymer reactable therewith in an organic solvent to prepare a toner solution; emulsifying or dispersing the toner solution in an aqueous medium to prepare a dispersion; reacting the active hydrogen-containing compound with the a polymer reactable therewith to granulate an adhesive base material; and removing the organic solvent therefrom. The thus prepared toner has high selectivity of resins; high low-temperature fixability and easiness of controlling a particle diameter, a particle diameter distribution and a shape.

Coloring of Toner

Methods of coloring toner are not particularly limited, and can be selected in accordance with the purposes. A black toner, a cyan toner, a magenta toner and a yellow toner are typically produced in many cases. The color toners are preferably prepared by properly selecting the above-mentioned colorants.

In order to improve fluidity, preservability, developability and transferability of the toner, the thus prepared parent toner can be mixed with an external additive (i.e., inorganic particles such as hydrophobic silica). Suitable mixers for use in mixing them other toner particles and an external additive include known mixers for mixing powders, which preferably have a jacket to control the inside temperature thereof. By changing the timing when the external additive is added or the addition speed of the external additive, the stress on the external additive (i.e., the adhesion state of the external additive with the mother toner particles) can be changed. Of course, by changing rotating number of the blade of the mixer used, mixing time, mixing temperature, etc., the stress can also be changed. In addition, a mixing method in which at first a relatively high stress is applied and then a relatively low stress is applied to the external additive, or vice versa, can also be used. Specific examples of the mixers include V-form mixers, locking mixers, Loedge Mixers, NAUTER MIXERS, HENSCHEL MIXERS and the like mixers. Then, coarse particles and aggregation particles are removed from a coarse toner through a sieve having 250 meshes or more to prepare a toner. Other components such as a particulate resin and a release agent may optionally be added to the toner.

(Developer Container)

The two-component developer of the present invention may be contained in a developer container. The developer container is not particularly limited and can be selected from known containers, and containers having a cap are preferably used.

The container may have a size, a shape, a structure, a material, etc. in accordance with the purposes. The container preferably has a cylindrical shape and spiral concavities and convexities on the inner circumferential face, and a part or all of which are accordion. Such a container transfers a developer therein to a discharge outlet thereof when rotated.

The container is preferably formed of a material having good size preciseness, such as a polyester resin, polyethylene, polypropylene, polystyrene, polyvinylchloride, polyacrylate, a polycarbonate resin, an ABS resin and polyacetal resin.

The developer container of the present invention is easy to store, transport and handle, and detachable from a process cartridge and an image forming apparatus to feed a developer thereto.

(Process Cartridge)

The process cartridge of the present invention includes at least an electrostatic latent image bearer bearing an electrostatic latent image and an image developer developing the electrostatic latent image borne with a developer to form a visual image, and further includes optional other means properly selected.

The image developer includes at least a developer container containing the two-component developer of the present invention and a developer bearer bearing and transferring the two-component developer of the present invention contained therein, and may optionally include a layer regulator regulating a toner layer borne on the surface of the developer bearer.

The process cartridge of the present invention is detachably installable in various electrophotographic image forming apparatuses, and it is preferable that it is detachably installed in the image forming apparatus mentioned later.

The process cartridge includes, as shown in FIG. 1, an electrostatic latent image bearer 101 and an image developer 104, and optionally includes a charger 102, a transferee 108, a cleaner 107 and other means. In FIG. 1, numeral 103 is irradiation from an irradiator and 105 is a recording medium.

The image forming process by the process cartridge in FIG. 1 will be explained. An electrostatic latent image corresponding to an irradiation image is formed on the surface of the electrostatic latent image bearer 101 after charged by the charger 102 and irradiated by the irradiation 103 while rotating. The electrostatic latent image is developed by the image developer 104 to form a visual image, and which is transferred by the transferer 108 onto the recording medium 105 to be printed out. The surface of the electrostatic latent image bearer after the visual image is transferred is cleaned by the cleaner 107 and further discharged by a discharger (not shown) while rotating at 360°, and is ready for charging by the charger 102 and the following operations to be repeated.

(Image Forming Apparatus and Image Forming Method)

The image forming apparatus of the present invention includes at least an electrostatic latent image bearer, an electrostatic latent image former, an image developer, a transferer and a fixer, and optionally includes other means such as a discharger, a cleaner, a recycler and a controller.

The image forming method of the present invention includes at least an electrostatic latent image forming process, a development process, a transfer process and a fixing process; and optionally includes other processes such as a discharge process, a cleaning process, a recycle process and a control process.

Electrostatic Latent Image Bearer and Electrostatic Latent Image Former

The electrostatic latent image forming process is a process of forming an electrostatic latent image on an electrostatic latent image bearer. The material, shape, structure, size, etc. of the electrostatic latent image bearer (a photoreceptor) are not particularly limited, and can be selected from known electrostatic latent image bearers. However, the electrostatic latent image bearer preferably has the shape of a drum, and the material is preferably an inorganic material such as amorphous silicon and serene.

The electrostatic latent image is formed by uniformly charging the surface of the electrostatic latent image bearer and irradiating imagewise light onto the surface thereof with the electrostatic latent image former. The electrostatic latent image former includes at least a charger uniformly charging the surface of the electrostatic latent image bearer and an irradiator irradiating imagewise light onto the surface thereof.

The surface of the electrostatic latent image bearer is charged with the charger upon application of voltage. The charger is not particularly limited, and can be selected in accordance with the purposes, such as an electroconductive or semiconductive rollers, bushes, films, known contact chargers with a rubber blade, and non-contact chargers using a corona discharge such as corotron and scorotron. The charger is preferably located in contact or not in contact with the electrostatic latent image bearer to charge the surface thereof upon application of a DC voltage and an AC voltage overlapped with each other. In addition, the charger is preferably a charging roller located close to the electrostatic latent image bearer not in contact therewith through a gap tape, to which a DC voltage overlapped with an AC voltage is applied to charge the surface of the electrostatic latent image bearer.

The surface of the electrostatic latent image bearer is irradiated with the imagewise light by the irradiator. The irradiator is not particularly limited, and can be selected in accordance with the purposes, provided that the irradiator can irradiate the surface of the electrostatic latent image bearer with the imagewise light, such as reprographic optical irradiators, rod lens array irradiators, laser optical irradiators and a liquid crystal shutter optical irradiators. In the present invention, a backside irradiation method irradiating the surface of the electrostatic latent image bearer through the backside thereof may be used.

Image Developer

The development process is a process of forming a visual image by developing the electrostatic latent image with the two-component developer of the present invention. The image developer is not particularly limited, and can be selected from known image developers, provided that the image developer can develop with the two-component developer of the present invention. For example, an image developer containing the two-component developer of the present invention and being capable of feeding the two-component developer to the electrostatic latent image in contactor not in contact therewith is preferably used, and an image developer including the toner container of the present invention is more preferably used.

The image developer may use a dry developing method or a wet developing method, and may develop a single color or a multiple colors. For example, the image developer preferably has a stirrer stirring the two-component developer to be frictionally charged and a rotatable magnet roller.

In the image developer, the toner and the carrier are mixed and stirred, and the toner is charged and held on the surface of the rotatable magnet roller in the shape of an ear to form a magnetic brush. Since the magnet roller is located close to the electrostatic latent image bearer (photoreceptor), a part of the toner is electrically attracted to the surface thereof. Consequently, the electrostatic latent image is developed with the toner to form a visual image thereon.

Transferer

The transfer process is a process of transferring the visual image onto a recording medium, and it is preferable that the visual image is firstly transferred onto an intermediate transferer and secondly transferred onto a recording medium thereby. It is more preferable that two or more visual color images are firstly and sequentially transferred onto the intermediate transferer and the resultant complex full-color image is transferred onto the recording medium thereby.

The visual image is transferred by the transferer using a transfer charger charging the electrostatic latent image bearer (photoreceptor). The transferee preferably includes a first transferer transferring two or more visual color images onto an intermediate transferer and a second transferer transferring the resultant complex full-color image onto the recording medium.

The intermediate transferer is not particularly limited, and can be selected from known transferers in accordance with the purposes, such as a transfer belt. Each of the first and second transferers is preferably at least a transferer chargeable to separate the visual image from the electrostatic latent image bearer (photoreceptor) toward the recoding medium. The transferer may be one, or two or more. The transferer includes a corona transferee using a corona discharge, a transfer belt, a transfer roller, a pressure transfer roller, an adhesive roller, etc.

The recording medium is not particularly limited, and can be selected from known recording media (paper).

Fixer

The fixing process is a process of fixing the visual image transferred onto the recording medium with a transferee, and each color toner may be fixed one by one or layered color toners may be fixed at the same time.

The fixer is not particularly limited, can be selected in accordance with the purposes, and known heating and pressurizing means are preferably used. The heating and pressurizing means include a combination of a heating roller and a pressure roller, and a combination of a heating roller, a pressure roller and an endless belt, etc. The fixer of the present invention preferably includes a heater equipped with a heating element, a film contacting the heater and pressurizer contacting the heater through the film, wherein a recording material an unfixed image is formed on passes through between the film and pressurizer to fix the unfixed image upon application of heat. The heating temperature is preferably from 80 to 200° C.

In the present invention, a known optical fixer may be used with or instead of the fixer in accordance with the purposes.

Discharger

The discharge process is a process of preferably discharging the electrostatic latent image bearer preferably with a discharger upon application of discharge bias. The discharger is not particularly limited, and can be selected from known dischargers, provided that the discharger can apply the discharge bias to the electrostatic latent image bearer, such as a discharge lamp.

Cleaner

The cleaning process is a process of preferably removing a toner remaining on the electrostatic latent image bearer with a cleaner. The cleaner is not particularly limited, and can be selected from known cleaners, provided that the cleaner can remove the toner remaining thereon, such as a magnetic brush cleaner, an electrostatic brush cleaner, a magnetic roller cleaner, a blade cleaner, a brush cleaner and web cleaner.

Toner Recycler

The toner recycle process is a process of preferably recycling a toner removed by the cleaner with a recycler. The recycler is not particularly limited, and known transporters can be used.

Controller

The control process is a process of preferably controlling the above-mentioned processes with a controller. The controller is not particularly limited, and can be selected in accordance with the purposes, provided the controller can control the above-mentioned means, such as a sequencer and a computer.

Embodiment 1 of Image Forming Apparatus

Figure 2:
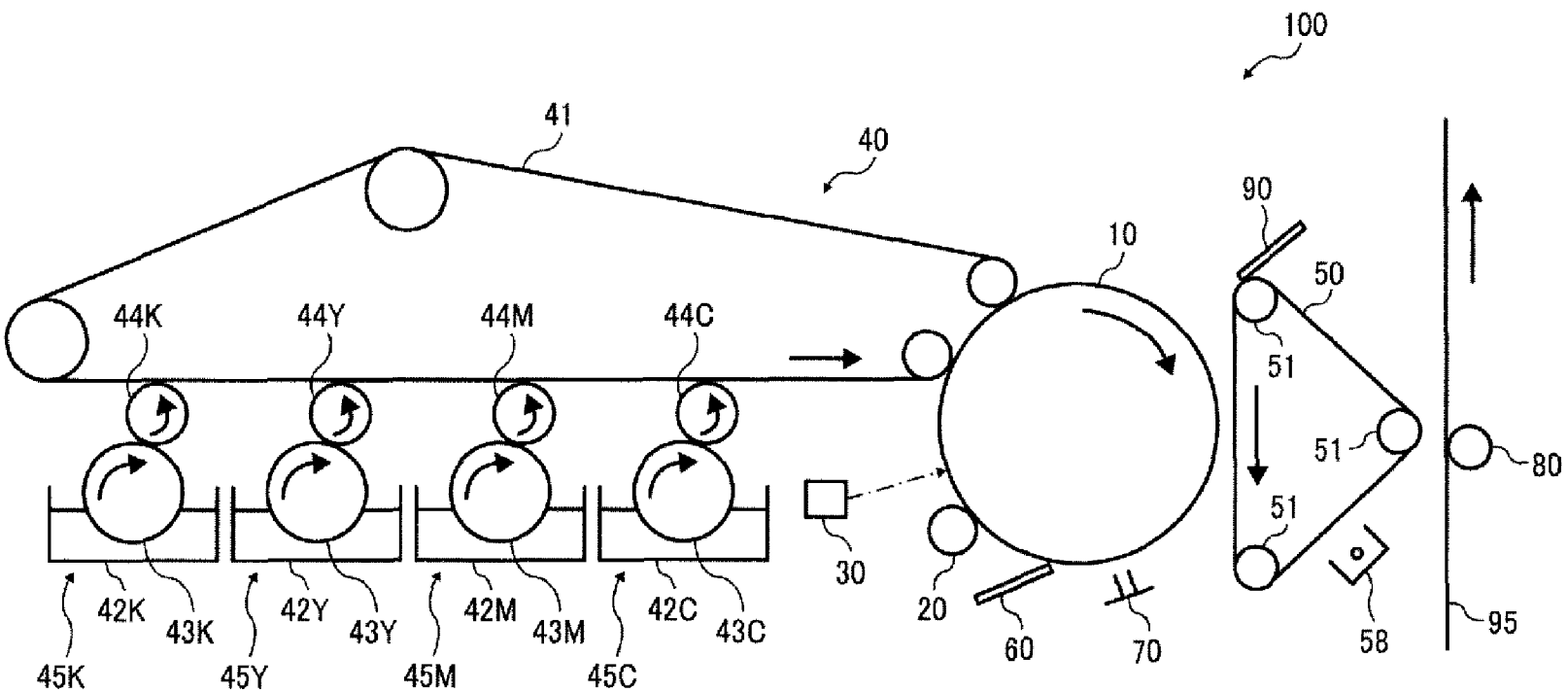
FIG. 2 is a schematic view illustrating an embodiment of the image forming apparatus of the present invention.

FIG. 2 is a schematic view illustrating an embodiment of the image forming apparatus of the present invention. An image forming apparatus 100 therein includes a photoreceptor drum 10 (hereinafter referred to as a photoreceptor 10) as an electrostatic latent image bearer, a charging roller as a charger 20, an irradiator 30, an image developer 40, an intermediate transferer 50, a cleaner 60 having a cleaning blade and a discharge lamp 70 as a discharger.

The intermediate transferer 50 is an endless belt suspended and extended by here rollers 51, and is transportable in the direction indicated by an arrow. The three rollers 51 partly work as a transfer bias roller capable of applying a predetermined first transfer bias to the intermediate transferer 50. A cleaner 90 having a cleaning blade is located close thereto and a transfer roller 80 capable of applying a transfer bias to a transfer paper 95 as a final transfer material to transfer (second transfer) the toner image thereon is located at the other side of the transfer paper 9. Around the intermediate transferer 50, a corona charger 58 charging the toner image thereon is located between a contact point of the photoreceptor 10 and the intermediate transferee 50 and a contact point of the intermediate transferer 50 and a transfer paper 95 in the rotating direction of the intermediate transferee 50.

The image developer 40 includes a developing belt 41 as a developer bearer, a black developing unit 45K, a yellow developing unit 45Y, a magenta developing unit 45M and a cyan developing unit 45C around the developing belt 41. The black developing unit 45K includes a developer container 42K, a developer feed roller 43K and a developing roller 44K; the yellow developing unit 45Y includes a developer container 42Y, a developer feed roller 43Y and a developing roller 44Y; the magenta developing unit 45M includes a developer container 42M, a developer feed roller 43M and a developing roller 44M; and the cyan developing unit 45C includes a developer container 42C, a developer feed roller 43C and a developing roller 44C. The developing belt 41 is an endless belt rotatably suspended and extended by plural rollers, and partly contacts the photoreceptor 10.

The charging roller 20 uniformly charges the photoreceptor 10. The irradiator 30 irradiates imagewise light to the photoreceptor 10 to form an electrostatic latent image thereon. The electrostatic latent image formed thereon is developed with a toner fed from the image developer 40 to form a visible image (toner image) thereon. The visible image (toner image) is transferred (first transfer) onto the intermediate transferer 50 with a voltage applied from the roller 51, and is further transferred (second transfer) onto a transfer paper 95. The toner remaining on the photoreceptor 10 is removed by a cleaner 60, and the photoreceptor 10 is discharged by the discharge lamp 70.

Embodiment 2 of Image Forming Apparatus

Figure 3:
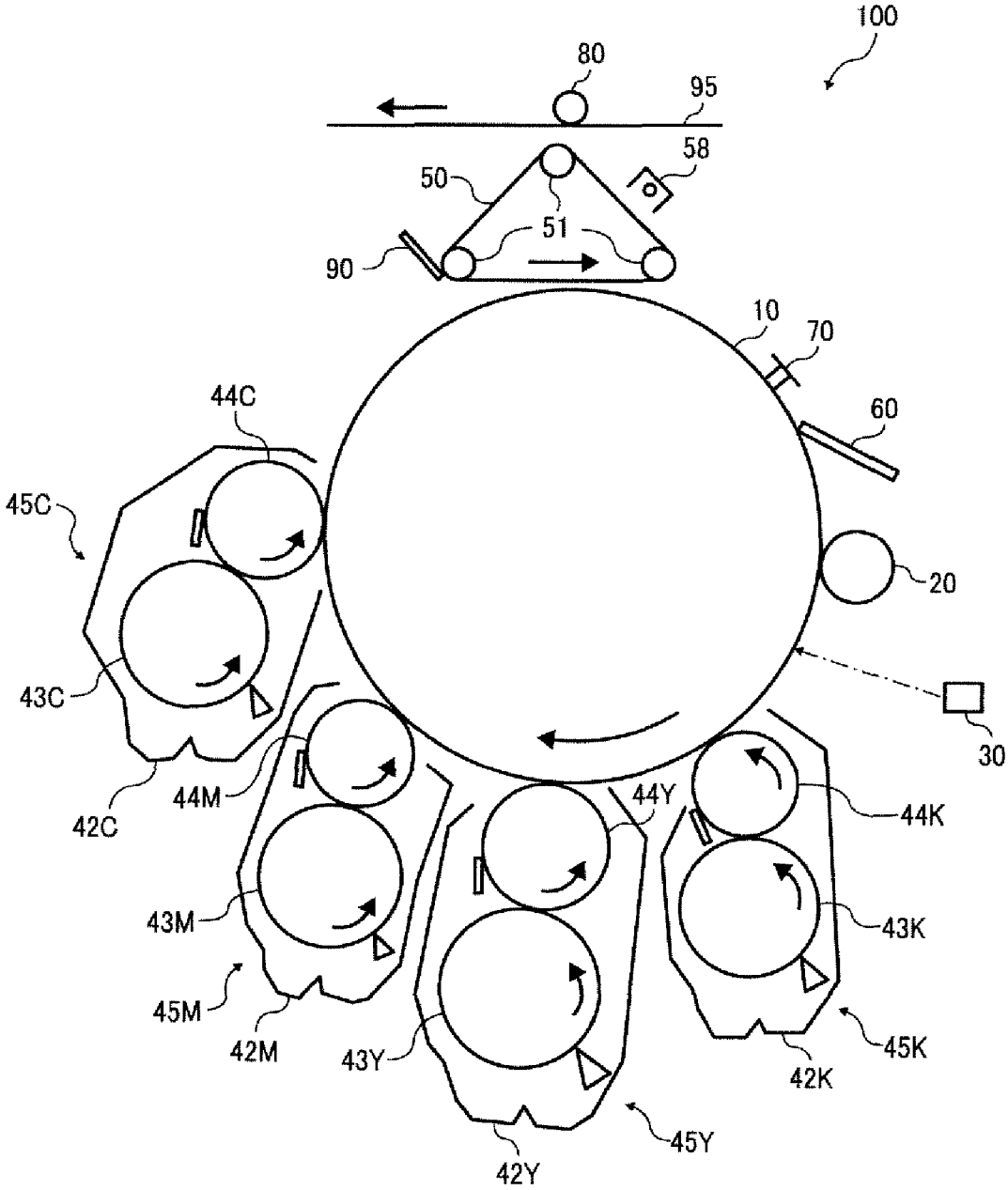
FIG. 3 is a schematic view illustrating another embodiment of the image forming apparatus of the present invention.

FIG. 3 is a schematic view illustrating another embodiment of the image forming apparatus of the present invention. An image forming apparatus 100 therein has the same constitutions as that of FIG. 2 except that the developing belt 41 is not located and the black developing unit 45K, yellow developing unit 45Y, magenta developing unit 45M and cyan developing unit 45C are located around the photoreceptor 10, facing thereto. The same elements therein have the same numbers as those in FIG. 2.

Embodiment 3 of Image Forming Apparatus

Figure 4:
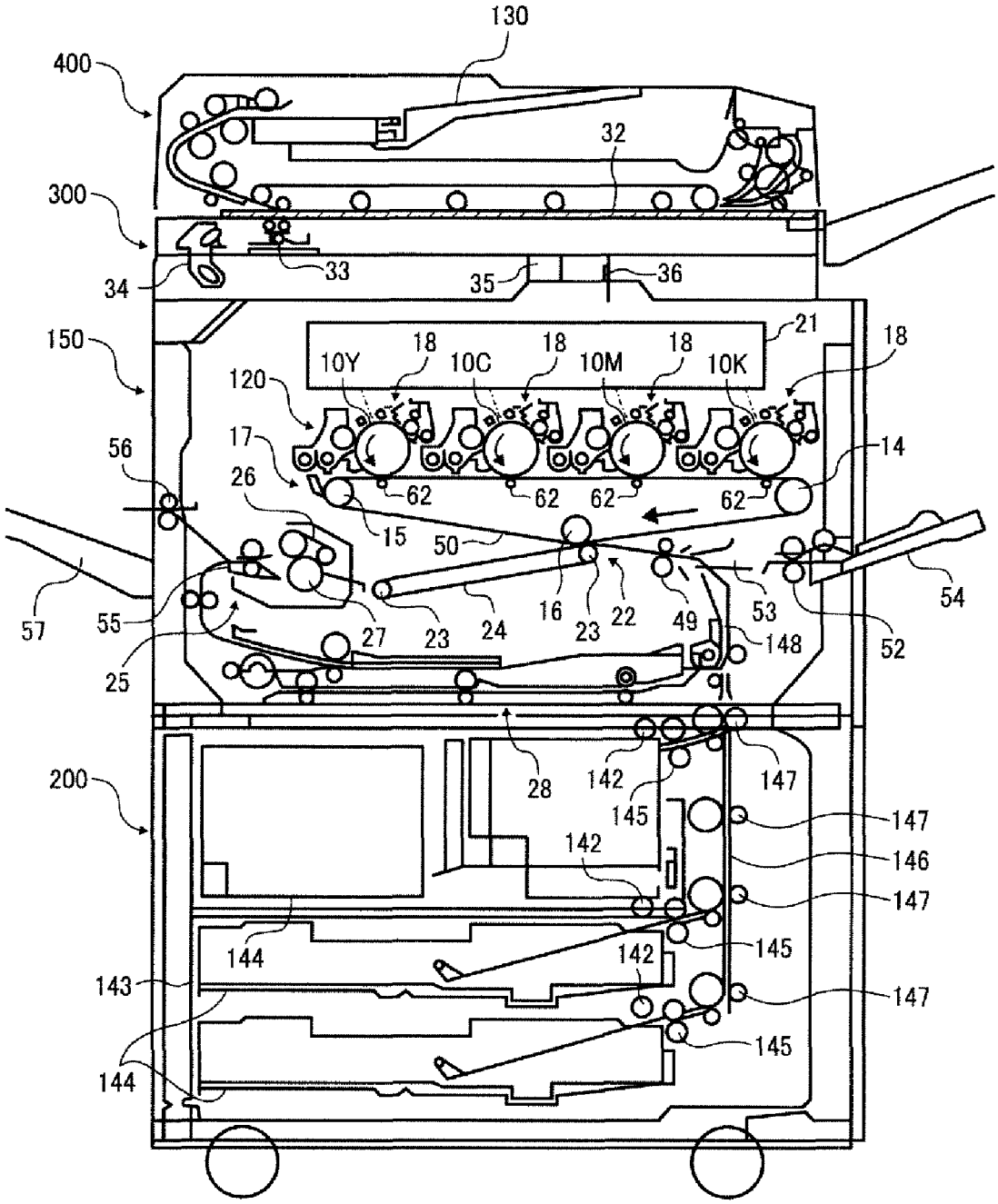
FIG. 4 is a schematic view illustrating a further embodiment of the image forming apparatus of the present invention.

FIG. 4 is a schematic view illustrating a further embodiment of the image forming apparatus for use in the present invention. The image forming apparatus therein is a tandem full-color image forming apparatus. The image forming apparatus includes a duplicator 150, a paper feeding table 200, a scanner 300 and an automatic document feeder (ADF) 400.

The duplicator 150 includes an intermediate transferee 50 having the shape of an endless belt. The intermediate transferer 50 is suspended by three suspension rollers 14, 15 and 16 and rotatable in a clockwise direction. On the left of the suspension roller 15, an intermediate transferee cleaner 17 is located to remove a residual toner on an intermediate transferer 50 after an image is transferred. Above the intermediate transferer 50, four image forming units 18 for yellow, cyan, magenta and black colors are located in line from left to right along a transport direction of the intermediate transferer 50 to form a tandem image forming developer 120. Above the tandem color image developer 120, an irradiator 21 is located.

On the opposite side of the tandem color image developer 120 across the intermediate transferer 50, a second transferee 22 is located. The second transferer 22 includes a an endless second transfer belt 24 and two rollers 23 suspending the endless second transfer belt 24, and is pressed against the suspension roller 16 across the intermediate transferer 50 and transfers an image thereon onto a sheet. Beside the second transferer 22, a fixer 25 fixing a transferred image on the sheet is located. The fixer 25 includes a an endless fixing belt 26 and a pressure roller 27 pressing the fixing belt 26.

Below the second transferer 22 and the fixer 25, a sheet reverser 28 reversing the sheet to form an image on both sides thereof is located in the tandem color image forming apparatus.

Full-color image formation using a tandem image developer 120 will be explained. An original is set on a table 130 of the ADF 400 to make a copy, or on a contact glass 32 of the scanner 300 and pressed with the ADF 400.

When a start switch (not shown) is put on, a first scanner 33 and a second scanner 34 scans the original after the original set on the table 30 of the ADF 400 is fed onto the contact glass 32 of the scanner 300, or immediately when the original set thereon. The first scanner 33 emits light to the original and reflects reflected light therefrom to the second scanner 34. The second scanner further reflects the reflected light to a reading sensor 36 through an imaging lens 35 to read the color original (color image) as image information of black, yellow, magenta and cyan.

Figure 5:
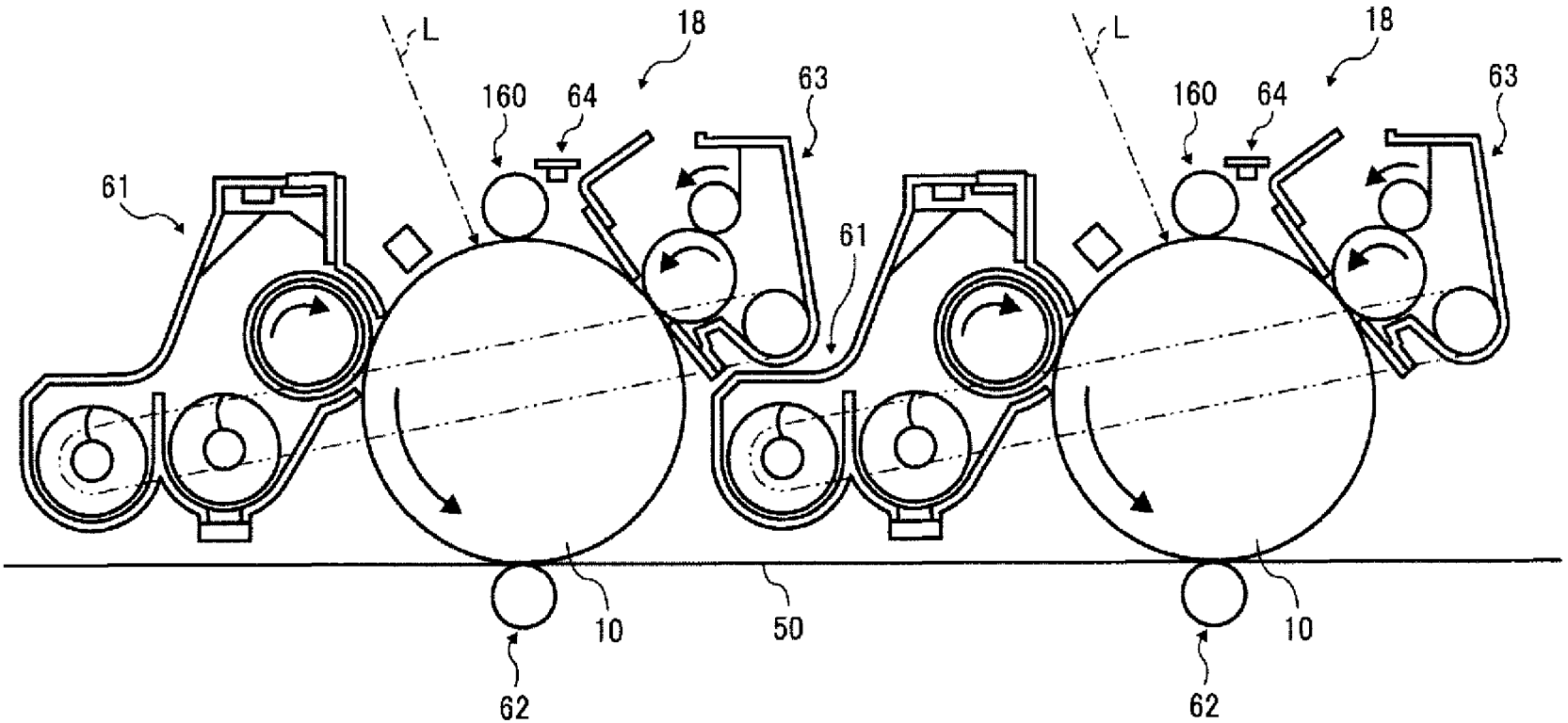
FIG. 5 is a detailed view illustrating a part of the image forming apparatus in FIG. 4.

The black, yellow, magenta and cyan image information are transmitted to each image forming units 18, i.e., a black image forming unit, a yellow image forming unit, a magenta image forming unit and a cyan image forming unit in the tandem image developer 120 respectively, and the respective image forming units form a black toner image, a yellow toner image, a magenta toner image and a cyan toner image. Namely, each of the image forming units 18 in the tandem image developer 120 includes, as shown in FIG. 5, a photoreceptor 10, i.e., a photoreceptor for black 10K, a photoreceptor for yellow 10Y, a photoreceptor for magenta 10M and a photoreceptor for cyan 10C; a charger 59 uniformly charging the photoreceptor; an irradiator irradiating the photoreceptor with imagewise light (L in FIG. 5) based on each color image information to form an electrostatic latent image thereon; an image developer 61 developing the electrostatic latent image with each color toner, i.e., a black toner, a yellow toner, a magenta toner and a cyan toner to form a toner image thereon; a transfer charger 62 transferring the toner image onto an intermediate transferer 50; a photoreceptor cleaner 63; and a discharger 64.

When a start switch (not shown) is put on, a drive motor (not shown) rotates one of the suspension rollers 14, 15 and 16 such that the other two rollers are driven to rotate, to rotate the intermediate transferer 50. At the same time, each of the image forming units 18 rotates a photoreceptor 10 and forms a single-colored image, i.e., a black image (K), a yellow image (Y), a magenta image (M) and cyan image (C) on each photoreceptor 10K, 10Y, 10M and 10C. The single-colored images are sequentially transferred (first transfer) onto the intermediate transferer 50 to form a full-color image thereon.

On the other hand, when start switch (not shown) is put on, one of paper feeding rollers 142 of paper feeding table 200 is selectively rotated to take a sheet out of one of multiple-stage paper cassettes 144 in a paper bank 143. A separation roller 145 separates sheets one by one and feed the sheet into a paper feeding route 146, and a feeding roller 147 feeds the sheet into a paper feeding route 148 to be stopped against a registration roller 49. Alternatively, a paper feeding roller 150 is rotated to take a sheet out of a manual feeding tray 51, and a separation roller 52 separates sheets one by one and feed the sheet into a paper feeding route 53 to be stopped against the registration roller 49. The registration roller 49 is typically earthed, and may be biased to remove a paper dust from the sheet. Then, in timing with a synthesized full-color image on the intermediate transferee 50, the registration roller 49 is rotated to feed the sheet between the intermediate transferer 50 and the second transferee 22, and the second transferer transfers (second transfer) the full-color image onto the sheet. The intermediate transferee 50 after transferring an image is cleaned by the intermediate transferee cleaner 17 to remove a residual toner thereon after the image is transferred.

The sheet the full-color image is transferred on is fed by the second transferee 22 to the fixer 25. The fixer 25 fixes the image thereon upon application of heat and pressure, and the sheet is discharged by a discharge roller 56 onto a catch tray 57 through a switch-over click 55. Alternatively, the switch-over click 55 feeds the sheet into the sheet reverser 28 reversing the sheet to a transfer position again to form an image on the backside of the sheet, and then the sheet is discharged by the discharge roller 56 onto the catch tray 57.

The image forming apparatus of the present invention using a two-component developer including the carrier of the present invention, having good adhesiveness between its coated layer and core material and preventing deterioration of image quality due to toner spent and abraded coated layer even when stirred for long periods, produces images with less toner scattering and background fouling for long periods.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

Examples

Example 1

(1) Preparation of Carrier (a) Reagents

The details and pre-treatments of main reagents used for preparation of the carrier are as follows.

Marketed products of isobutylmethoxysilane (IBTMS from AZmax Co.), 3-methacryloyltrimethoxysilane (S710 from AZmax Co.), 2-isobutybromide (from Tokyo Chemical Industry Co., Ltd.), Copper chloride (I), pentamethyldiethylenetriamine (PMDETA from Tokyo Chemical Industry Co., Ltd.), tetrahydrofuran (THF from NAKALAI TESQUE, INC.), methanol (from NAKALAI TESQUE, INC.) and concentrated sulfuric acid (from NAKALAI TESQUE, INC.) were used as they are.

A marketed product of triethylamine (from NAKALAI TESQUE, INC.) was distilled under a nitrogen stream. Marketed product of toluene (from NAKALAI TESQUE, INC.) was distilled under the presence of hydrogenated calcium under a nitrogen stream. A marketed product of methylmethacrylate (MMA from NAKALAI TESQUE, INC.) was distilled under the presence of hydrogenated calcium under a reduced pressure. A marketed product of 2-hydroxyethylmethacrylate (HEMA from NAKALAI TESQUE, INC.) was distilled under a reduced pressure.

SQA-1 (ATRP-starting-group-substituted polyhedral oligomeric polysilsesquioxane) was synthesized by the following method.

A slide three-opening flask having a capacity of 2,000 ml, a ball reflux condenser, a three-direction cock, a mechanical stirrer and a thermometer was substituted with nitrogen and under a nitrogen stream.

28.8 g of 1N sodiumhydroxide solution, 132 g of S710 (0.530 mol), 94.9 g of isobutylmethoxysilane (IBTMS) (0.530 mol) and 1,600 ml of tetrahydrofuran were reacted in the flask at 60° C. for 3 hrs. The solution was cooled to have room temperature and 1.5 ml of concentrated sulfuric acid was added thereto to neutralize. After the content having a low boiling point therein was removed by a rotary evaporator, the solution was returned into the flask and 1,600 ml of methanol and 4 ml of concentrated sulfuric acid were added thereto, and the solution was stirred at room temperature for 24 hrs to perform a hydrolysis reaction of 3-methacryloylpropyl group. After completion of the hydrolysis reaction was confirmed by $^{1}$H-NMR, a saturated aqueous solution of sodium hydrogen carbonate was added to thereto to neutralize. After the content having a low boiling point therein was removed by a rotary evaporator, the solution was extracted with tetrahydrofuran and washed with saturated saline, and dehydrated with anhydrous magnesium sulfate. The content having a low boiling point therein was removed by a rotary evaporator to prepare a hydroxy substituted polyhedral oligomeric polysilsesquioxane (SQH-1). The yield quantity and the yield rate thereof were 80.0 g and 68.6%, respectively.

Next, a slide three-opening flask having a capacity of 1,000 ml, a three-direction cock, a magnetic stirrer, a drop funnel having a capacity of 200 ml, a septum cap and a thermometer was deaerated, dried and substituted with argon. 80.0 g (Si—OH equivalent of 364 mmol) of the polyhedral oligomeric polysilsesquioxane SQH-1, 40.4 g (400 mmol) of triethylamine and 500 ml of dried diethylether were placed in the flask, and the solution was cooled to have a temperature not higher than 0° C. with dry-ice methanol. A solution including 100 ml of THF and 83.7 g (364 ml) of 2-isobutylbromide was dropped in the cooled solution. The solution was stirred at 0° C. for 1 hr and further stirred at room temperature for 18 hrs. An ammonium salt was removed from the solution through filtration under reduced pressure, the content having a low boiling point therein was removed by a rotary evaporator, and the solution was extracted with THF. The solution was washed with distilled water and dehydrated with anhydrous magnesium sulfate. After filtered, the content having a low boiling point in the solution was removed by a rotary evaporator to prepare SQA-1 (ATRP-starting-group-substituted polyhedral oligomeric polysilsesquioxane). The yield quantity and the yield rate thereof were 127 g and 94.9%, respectively. SQA-1 had a number-average molecular weight of 1,930 and a weight-average molecular weight of 2,920. SQA-1 had spectra of from 0.55 to 0.73 (4H), 0.90 to 1.00 (3H), 1.70 to 1.90 (2H), 1.90 to 1.97 (7H) and 4.1 to 4.2 (2H) when subjected to $^{1}$H-NMR (deurated chloroform, tetramethylsilane internal standard) measurement. SQA-1 had a spectrum (peak) of −68 when subjected to $^{29}$Si-NMR (deuterated chloroform, tetramethylsilane internal standard) measurement.

(b) Preparation of Binder Resin 1

A slide three-opening flask having a capacity of 2,000 ml, a three-direction cock, a magnetic stirrer, a Dimroth condenser having a capacity of 200 ml, a septum and a thermometer was deaerated, dried and substituted with argon. 60.0 g (163 mmol) of SQA-1 as a polymerization initiating group, 570 g (5.69 mol) of MMA, 30.0 g (0.231 mol) of HEMA, 8.07 g (81.5 mmol) of copper chloride (I) and 1,000 ml of toluene were placed therein, and the solution was subjected to freeze deaeration for 3 times and under an argon stream. The solution was heated to have a temperature of 70° C. in an oil bath while magnetically stirred. After the solution was heated, 14.1 g (81.5 mmol) of PMDETA were added thereto to be reacted therewith for 3 hrs. The reaction solution changed to be dark green. The reaction temperature increased up to 90° C. and then returned to 70° C. After the reaction, the solution was trisected to Erlenmeyer flasks having a capacity of 21. 1,000 ml of toluene and 500 ml of silica gel #60 were added to each of the flasks, and each of the solution was stirred at room temperature for 24 hrs. Then, the solution changed to be buff yellow. After insoluble matters were filtered under reduced pressure with hyflosuper-cel (from NAKALAI TESQUE, INC.), THF was added to the solution to be diluted and have a volume of 61. This THF solution was added to hexane having a volume six times as much as that thereof while strongly stirred, and a colorless solid settled out when reprecipitated. The colorless solid was dried by a decompression dryer until it had a constant mass to prepare a [binder resin 1]. The yield quantity and the yield rate thereof were 569 g and 95.0%, respectively. The binder resin had a number-average molecular weight of 25,900, a weight-average molecular weight of 102,000 and a polydispersity of 3.9. The [binder resin 1] had spectra of from 0.60 to 1.00, 1.60 to 2.00, 3.40 to 3.55 and 3.6 to 4.1 when subjected to $^{1}$H-NMR (deurated chloroform, tetramethylsilane internal standard) measurement.

(c) Preparation of Carrier 1

The following materials were placed in toluene such that solid contents have a concentration of 20%, and the mixture was dispersed by a homomixer for 10 min to prepare a [coated layer liquid 1].

| | |
|---|---|
| Binder resin 1 | 75 |
| Particulate alumina (SUMICORUNDUM AA-04 having a diameter of 0.4 μm from Sumitomo Chemical Co., Ltd.) | 25 |
| Amino silane coupling agent (SH6020 including a solid content in an amount of 100% by weight from Dow Corning Toray Silicone Co., Ltd.) | 1.2 |

Next, a ferrite powder having a saturated magnetic moment Of 65 emu/g at 1 k gauss was coated by a roll fluidizing coater on with the [coated layer liquid 1] to have a coated layer thickness of 1.0 μm, and dried to prepare a carrier precursor. The carrier precursor was burned at 180° C. for 60 min in an electric oven, cooled, and pulverized with a sieve having an opening of 90 μm to prepare a [carrier 1].

The [carrier 1] had a weight-average particle diameter (Dw) of 38.91 μm, a number-average particle diameter (Dn) of 34.74 μm and Dw/Dn of 1.12 when measured by Microtrac HRA9320-X100 from Microtrac, Inc. The [carrier 1] had a volume resistivity of 14.2 log Ω·cm. These are shown in Table 1.

(2) Preparation of Toner 1

Preparation of Organic Particulate Emulsion 683 parts of water, 11 parts of a sodium salt of an adduct of a sulfuric ester with ethyleneoxide methacrylate (ELEMINOL RS-30 from Sanyo Chemical Industries, Ltd.), 83 parts of styrene, 166 parts of methacrylate, 110 parts of butylacrylate and 1 part of persulfate ammonium were mixed in a reactor vessel including a stirrer and a thermometer, and the mixture was stirred for 30 min at 3,800 rpm to prepare a white emulsion therein. The white emulsion was heated to have a temperature of 75° C. and reacted for 4 hrs. Further, 30 parts of an aqueous solution of persulfate ammonium having a concentration of 1% were added thereto and the mixture was reacted for 6 hrs at 75° C. to prepare an aqueous dispersion [particulate dispersion 1] of a vinyl resin (a copolymer of a sodium salt of an adduct of styrene-methacrylate-butylacrylate-sulfuric ester with ethyleneoxide methacrylate).

The [particulate dispersion 1] was measured by LA-920 to find a volume-average particle diameter thereof was 110 nm. A part of the [particulate dispersion 1] was dried to isolate a resin component therefrom. The resin component had a glass transition temperature (Tg) of 58° C. and a weight-average molecular weight of 130,000.

Preparation of Aqueous Phase 990 parts of water, 83 parts of the [particulate dispersion 1], 37 parts of an aqueous solution of sodium dodecyldiphenyletherdisulfonate having a concentration of 48.5% (ELEMINOL MON-7 from Sanyo Chemical Industries, Ltd.) and 90 parts of ethyl acetate were mixed and stirred to prepare a lacteous liquid an [aqueous phase 1].

Preparation of Low-Molecular-Weight Polyester 229 parts of an adduct of bisphenol A with 2 moles of ethyleneoxide, 529 parts of an adduct of bisphenol A with 3 moles of propyleneoxide, 208 parts terephthalic acid, 46 parts of adipic acid and 2 parts of dibutyltinoxide were polycondensated in a reactor vessel including a cooling pipe, a stirrer and a nitrogen inlet pipe for 11 hrs at a normal pressure and 230° C. Further, after the mixture was depressurized by 10 to 15 mm Hg and reacted for 5 hrs, 44 parts of trimellitic acid anhydride were added thereto and the mixture was reacted for 3 hrs at a normal pressure and 180° C. to prepare a [low-molecular-weight polyester 1]. The [low-molecular-weight polyester 1] had a number-average molecular weight of 2,300, a weight-average molecular weight of 6,700, a Tg of 43° C. and an acid value of 25 mg KOH/g.

Preparation of Intermediate Polyester and Prepolymer 682 parts of an adduct of bisphenol A with 2 moles of ethyleneoxide, 81 parts of an adduct of bisphenol A with 2 moles of propyleneoxide, 283 parts terephthalic acid, 22 parts of trimellitic acid anhydride and 2 parts of dibutyltinoxide were mixed and reacted in a reactor vessel including a cooling pipe, a stirrer and a nitrogen inlet pipe for 8 hrs at a normal pressure and 230° C. Further, after the mixture was depressurized to 10 to 15 mm Hg and reacted for 5 hrs to prepare an [intermediate polyester 1]. The [intermediate polyester 1] had a number-average molecular weight of 2,200, a weight-average molecular weight of 9,700, a Tg of 54° C. and an acid value of 0.5 and a hydroxyl value of 52 mg KOH/g.

Next, 410 parts of the [intermediate polyester 1], 89 parts of isophoronediisocyanate and 500 parts of ethyl acetate were reacted in a reactor vessel including a cooling pipe, a stirrer and a nitrogen inlet pipe for 5 hrs at 100° C. to prepare a [prepolymer 1]. The [prepolymer 1] included a free isocyanate in an amount of 1.53% by weight.

Preparation of Ketimine 170 parts of isophorondiamine and 75 parts of methyl ethyl ketone were reacted at 50° for 4 hrs in a reaction vessel including a stirrer and a thermometer to prepare a [ketimine compound 1] The [ketimine compound 1] had an amine value of 417.

Preparation of Masterbatch (MB)

1,200 parts of water, 540 parts of carbon black Printex 35 from Degussa A.G. having a DBP oil absorption of 42 ml/100 mg and a pH of 9.5, 1,200 parts of the unmodified polyester resin were mixed by a Henschel Mixer from Mitsui Mining Co., Ltd. After the mixture was kneaded by a two-roll mill having a surface temperature of 150° C. for 30 min, the mixture was extended by applying pressure, cooled and pulverized by a pulverizer from Hosokawa Micron Limited to prepare a [masterbatch 1].

Preparation of Oil Phase 378 parts of the [low-molecular-weight polyester 1], 110 parts of carnauba wax and 947 parts of ethyl acetate were mixed in a reaction vessel including a stirrer and a thermometer. The mixture was heated to have a temperature of 80° C. while stirred. After the temperature of 80° C. was maintained for 5 hrs, the mixture was cooled to have a temperature of 30° C. in an hour. Then, 500 parts of the [masterbatch 1] and 500 parts of ethyl acetate were added to the mixture and mixed for 1 hr to prepare a [material solution 1].

1,324 parts of the [material solution 1] were transferred into another vessel, and the carbon black and wax therein were dispersed by a beads mill (Ultra Visco Mill from IMECS CO., LTD.) for 3 passes under the following conditions:

liquid feeding speed of 1 kg/hr; peripheral disc speed of 6 m/sec; and filling zirconia beads having diameter of 0.5 mm for 80% by volume.

Next, 1,324 parts of an ethyl acetate solution of the [low-molecular-weight polyester 1] having a concentration of 65% were added to the [material solution 1] and the mixture was stirred by the beads mill for 1 pass under the same conditions to prepare a [pigment and wax dispersion liquid 1]. The [pigment and wax dispersion liquid 1] had a solid content concentration of 50% at 130° C. for 30 min.

Emulsification and De-solvent 749 parts of the [pigment and wax dispersion liquid 1], 115 parts of the [prepolymer 1] and 2.9 parts of the [ketimine compound 1] were mixed in a vessel by a TK homomixer from Tokushu Kika Kogyo Co., Ltd. at 5,000 rpm for 1 min. 1,200 parts of the [aqueous phase 1] were added to the mixture and mixed by the TK homomixer at 12,500 rpm for 30 min to prepare an [emulsified slurry 1].

The [emulsified slurry 1] was put in a vessel including a stirrer and a thermometer. After a solvent was removed from the emulsified slurry 1 at 30° C. for 8 hrs, the slurry was aged at 40° C. for 24 hrs to prepare a [dispersion slurry 1].

Washing and Drying

After 100 parts the [dispersion slurry 1] was filtered under reduced pressure to prepare a filtered cake (a), the following washings and filtrations were repeated, and dried to prepare [mother toner particles 1].

(1) 100 parts of ion-exchange water were added to the filtered cake (a) and mixed by the TK homomixer at 12,000 rpm for 10 min, and the mixture was filtered to prepare a filtered cake (b).

(2) 100 parts of an aqueous solution of 10% sodium hydrate were added to the filtered cake and mixed by the TK homomixer at 12,000 rpm for 30 min, and the mixture was filtered under reduced pressure to prepare a filtered cake (c).

(3) 100 parts of 10% hydrochloric acid were added to the filtered cake and mixed by the TK homomixer at 12,000 rpm for 10 min, and the mixture was filtered to prepare a filtered cake (d).

(4) 300 parts of ion-exchange water were added to the filtered cake and mixed by the TK homomixer at 12,000 rpm for 10 min, and the mixture was filtered. This operation was repeated again to prepare a [filtered cake 1].

The [filtered cake 1] was dried by an air drier at 45° C. for 48 hrs and sieved by a mesh having an opening of 75 μm to prepare a particulate material to prepare [mother toner particles 1] having a volume-average particle diameter of 6.1 μm, a number-average particle diameter of 5.4 μm and an average circularity of 0.972.

Preparation of [Toner 1]

Finally, 0.7 parts of hydrophobic silica and 0.3 parts of hydrophobic titanium oxide were mixed with 100 parts of the [mother toner particles 1] by a HENSCHEL MIXER to prepare a [toner 1].

(3) Preparation of Two-Component Developer 1

The [toner 1] and the [carrier 1] were missed by TURBULA MIXER from Shinmaru Enterprises Corp. such that the carrier was covered by the toner by 50% to prepare a [developer 1].

<Evaluation of [Developer ]>

Separation and abrasion of the coated layer, toner spent, image density, toner scattering and background fouling were evaluated, using the developer 1.

Evaluation of Separation and Abrasion of the Coated Layer (SAL)

200,000 images were produced by a tandem full-color image forming apparatus imagio Neo 450 from Ricoh Company, Ltd. with the developer, and a ratio of amounts of decrease of resistance (an amount of decrease of resistance after 200,000 images were produced/an initial amount of decrease of resistance) was measured and evaluated under the following standard

[Evaluation Standard]

◎: 1/10 or more

○: 1/100 or more and less than 1/10

Δ: 1/1,000 or more and less than 1/100 x: less than 1/1,000

The amount of decrease of resistance is measured as follows:

placing the carrier before used in a gap of 2 mm between parallel electrodes to apply a DC 200 V thereto;

measuring a resistivity thereof after 30 sec with a High Resistance Meter from YOKOKAWA HEWLETT PACKARD LTD to convert the resistivity into a volume resistivity (R1);

removing the toner from the developer after producing 200,000 images with a blow off apparatus to obtain the carrier;

measuring a volume resistivity (R2) thereof by the same method; and deducting R2 from R1.

The amount of decrease of resistance is preferably not greater than 2.0 [Log (Ω·cm)]. Since the decrease of resistance is caused by leaving of the coated layer from the core material, the abrasion thereof is reduced to prevent the decrease of resistance. Typically, the resistance is largest before producing images.

Evaluation of Toner Spent (TS)

200,000 images of a chart having an image area of 20% were produced by a tandem full-color image forming apparatus imagio Neo 450 from Ricoh Company, Ltd. with the developer while the image density was controlled to have 1.4±0.2, and a ratio of charge quantity (a charge quantity after 200,000 images were produced/an initial charge quantity) was measured and evaluated under the following standard. The charge quantity was measured by a blow off method.

[Evaluation Standard]

◎: less than 15%

○: 15% or more and less than 30%

Δ: 30% or more and less than 50% x: 50% or more

When a toner is spent on a carrier, the composition of an outermost surface of the carrier changes, resulting in deterioration of charge quantity. The less the change, the less the toner spent.

Evaluation of Image Density (ID)

200,000 solid images were produced by a tandem full-color image forming apparatus imagio Neo 450 from Ricoh Company, Ltd. with the developer on copy papers TYPE6000<70W> from Ricoh Company, Ltd. such that the developer adhered thereon in an amount of 1.00±0.05 mg/cm$^2$.

The image density of the initial solid image and after 200,000 images were produced were visually observed to evaluate under the following standard.

[Evaluation Standard]

◎: High quality images were produced without deterioration of image density.

○: High quality images were produced although image density slightly deteriorated.

Δ: Image density and quality deteriorated.

x: Image density and quality largely deteriorated.

Evaluation of Toner Scattering (TSC)

200,000 images of a chart having an image area of 5% were produced by a tandem full-color image forming apparatus imagio Neo 450 from Ricoh Company, Ltd. with the developer, and toner contamination in the apparatus was visually observed to evaluate under the following standard.

◎: Not contaminated at all

○: Slightly contaminated

Δ: Contaminated, but usable x: Seriously contaminated and unusable

Evaluation of Background Fouling (BF)

200,000 images of a chart having an image area of 5% were produced by a tandem full-color image forming apparatus imagio Neo 450 from Ricoh Company, Ltd. with the developer, and background fouling was visually observed to evaluate under the following standard.

○: No background fouling

Δ: Slight background fouling x: Apparent background fouling

Overall Evaluation (OA)

◎: Very good

○: Good

Δ: Poor x: Seriously poor

The procedures for evaluation in Example 1 were repeated except for using developers prepared in the following Examples and Comparative Examples. The evaluation results are shown in Table 2.

Example 2

(1) Preparation of Carrier 2

The procedure for preparation of the [carrier 1] in Example 1 was repeated except for replacing the [coated layer liquid 1] with a [coated layer liquid 2] having the following formulation to prepare a [carrier 2].

| | |
|---|---|
| Binder resin 1 | 70 |
| Guanamine solution (MYCOAT 106 including a sold content in an amount of 77% by weight from Mitsui Cytec, Ltd.) | 39 |
| Amino silane coupling agent (SH6020 including a solid content in an amount of 100% by weight from Dow Corning Toray Silicone Co., Ltd.) | 0.5 |

A weight-average particle diameter (Dw), a number-average particle diameter (Dn), Dw/Dn and a volume resistivity of the [carrier 2] measured as the [carrier 1] was are shown in Table 1.

(2) Preparation of Two-Component Developer 2

The procedure for preparation of the [two-component Developer 1] in Example 1 was repeated except for replacing the [carrier 1] with the [carrier 2] to prepare a [two-component developer 2].

(3) Evaluation of the Two-Component Developer 2

The procedure for evaluation of the [two-component developer 1] in Example 1 was repeated except for replacing the [two-component Developer 1] with the [two-component developer 2] to evaluate the [two-component developer 2]. The results are shown in Table 2.

Example 3

(1) Preparation of Carrier 3

(a) Preparation of Binder Resin 2

A slide three-opening flask having a capacity of 500 ml, a three-direction cock, a magnetic stirrer, a Dimroth condenser, a septum and a thermometer was deaerated, dried and substituted with argon. 1.85 g (5.00 mmol) of SQA-1 as a polymerization initiating group, 47.5 g (475 mmol) of MMA, 3.25 g (25.0 mmol) of HEMA, 0.248 g (2.50 mmol) of copper chloride (I) and 100 ml of toluene were placed therein, and the solution was subjected to freeze deaeration for 3 times and under an argon stream. The solution was heated to have a temperature of 70° C. in an oil bath while magnetically stirred. After the solution was heated, 0.217 g (1.25 mmol) of PMDETA were added thereto to be reacted therewith at 70° C. for 23.5 hrs. The reaction solution changed to be dark green. After the reaction, 100 ml of toluene and 50 ml of silica gel #60 were added thereto and stirred at room temperature for 24 hrs. Then, the solution changed to be buff yellow. After insoluble matters were filtered under reduced pressure with hyflo super-cel (from NAKALAI TESQUE, INC.), THF was added to the solution to be diluted and have a volume of 11. This THF solution was added to 61 of hexane while strongly stirred, and a colorless solid settled out when reprecipitated. The colorless solid was dried by a decompression dryer until it had a constant mass to prepare a [binder resin 2]. The yield quantity and the yield rate thereof were 16.0 g and 30.4%, respectively. The binder resin had a number-average molecular weight of 17,000, a weight-average molecular weight of 340,000 and a polydispersity of 2.0. The [binder resin 2] had spectra of from 0.60 to 1.00, 1.60 to 2.00, 3.40 to 3.55 and 3.6 to 4.1 when subjected to $^{1}$H-NMR (deurated chloroform, tetramethylsilane internal standard) measurement as the [binder resin 1] was.

(b) Preparation of Carrier 3

The procedure for preparation of the [carrier 1] in Example 1 was repeated except for replacing the [coated layer liquid 1] with a [coated layer liquid 3] having the following formulation to prepare a [carrier 3].

| | |
|---|---|
| Binder resin 2 | 100 |

A weight-average particle diameter (Dw), a number-average particle diameter (Dn), Dw/Dn and a volume resistivity of the [carrier 2] measured as the [carrier 1] was are shown in Table 1.

(2) Preparation of Two-Component Developer 3

The procedure for preparation of the [two-component developer 1] in Example 1 was repeated except for replacing the [carrier 1] with the [carrier 3] to prepare a [two-component developer 3].

(3) Evaluation of the Two-Component Developer 3

The procedure for evaluation of the [two-component developer 1] in Example 1 was repeated except for replacing the [two-component developer 1] with the [two-component developer 3] to evaluate the [two-component developer 3]. The results are shown in Table 2.

Example 4

(1) Preparation of Carrier 4

The procedure for preparation of the [carrier 1] in Example 1 was repeated except for replacing the [coated layer liquid 1] with a [coated layer liquid 4] having the following formulation to prepare a [carrier 4].

| | |
|---|---|
| Binder resin 2 | 100 |
| Block polyisocyanate (Takenate B-882N including a solid content in an amount of 70% by weight from Mitsui Chemicals, Inc.) | 28.6 |
| Amino silane coupling agent (SH6020 including a solid content in an amount of 100% by weight from Dow Corning Toray Silicone Co., Ltd.) | 0.5 |

A weight-average particle diameter (Dw), a number-average particle diameter (Dn), Dw/Dn and a volume resistivity of the [carrier 4] measured as the [carrier 1] was are shown in Table 1.

(2) Preparation of Two-Component Developer 4

The procedure for preparation of the [two-component developer 1] in Example 1 was repeated except for replacing the [carrier 1] with the [carrier 4] to prepare a [two-component developer 4].

(3) Evaluation of the Two-Component Developer 4

The procedure for evaluation of the [two-component developer 1] in Example 1 was repeated except for replacing the [two-component Developer 1] with the [two-component developer 4] to evaluate the [two-component developer 4]. The results are shown in Table 2.

Example 5

(1) Preparation of Carrier 5

(a) Preparation of Binder Resin 3

A slide three-opening flask having a capacity of 500 ml, a three-direction cock, a magnetic stirrer, a Dimroth condenser, a drop funnel having a capacity of 100 ml a septum and a thermometer was deaerated, dried and substituted with argon. 1.85 g (5.00 mmol) of SQA-1 as a polymerization initiating group, 47.5 g (475 mmol) of MMA, 3.25 g (25.0 mmol) of HEMA, 0.248 g (2.50 mmol) of copper chloride (I) and 100 ml of toluene were placed therein, and the solution was subjected to freeze deaeration for 3 times and under an argon stream. The solution was heated to have a temperature of 70° C. in an oil bath while magnetically stirred. After the solution was heated, 0.217 g (1.25 mmol) of PMDETA were added thereto to be reacted therewith at 70° C. for 15.5 hrs. The reaction solution changed to be dark green. After the reaction, 100 ml of toluene and 50 ml of silica gel #60 were added thereto and stirred at room temperature for 24 hrs. Then, the solution changed to be buff yellow. After insoluble matters were filtered under reduced pressure with hyflo super-cel (from NAKALAI TESQUE, INC.), THF was added to the solution to be diluted and have a volume of 11. This THF solution was added to 61 of hexane while strongly stirred, and a colorless solid settled out when reprecipitated. The colorless solid was dried by a decompression dryer until it had a constant mass to prepare a [binder resin 3]. The yield quantity and the yield rate thereof were 23.2 g and 44.1%, respectively. The binder resin had a number-average molecular weight of 24,000, a weight-average molecular weight of 34,000 and a polydispersity of 1.4. The [binder resin 3] had spectra of from 0.60 to 1.00, 1.60 to 2.00, 3.40 to 3.55 and 3.6 to 4.1 when subjected to $^{1}$H-NMR (deurated chloroform, tetramethylsilane internal standard) measurement as the [binder resin 1] was.

(b) Preparation of Carrier 5

The procedure for preparation of the [carrier 1] in Example 1 was repeated except for replacing the [coated layer liquid 1] with a [coated layer liquid 5] having the following formulation to prepare a [carrier 5].

| | |
|---|---|
| Binder resin 3 | 70 |
| Guanamine solution (MYCOAT 106 including a sold content in an amount of 77% by weight from Mitsui Cytec, Ltd.) | 39 |

A weight-average particle diameter (Dw), a number-average particle diameter (Dn), Dw/Dn and a volume resistivity of the [carrier 5] measured as the [carrier 1] was are shown in Table 1.

(2) Preparation of Two-Component Developer 5

The procedure for preparation of the [two-component Developer 1] in Example 1 was repeated except for replacing the [carrier 1] with the [carrier 5] to prepare a [two-component developer 5].

(3) Evaluation of the Two-Component Developer 5

The procedure for evaluation of the [two-component developer 1] in Example 1 was repeated except for replacing the [two-component Developer 1] with the [two-component developer 5] to evaluate the [two-component developer 5]. The results are shown in Table 2.

Example 6

(1) Preparation of Carrier 6

The procedure for preparation of the [carrier 1] in Example 1 was repeated except for replacing the [coated layer liquid 1] with a [coated layer liquid 4] having the following formulation to prepare a [carrier 4].

| | |
|---|---|
| Binder resin 3 | 70 |
| Particulate alumina (SUMICORUNDUM AA-04 having a diameter of 0.4 μm from Sumitomo Chemical Co., Ltd.) | 30 |
| Amino silane coupling agent (SH6020 including a solid content in an amount of 100% by weight from Dow Corning Toray Silicone Co., Ltd.) | 1.2 |

A weight-average particle diameter (Dw), a number-average particle diameter (Dn), Dw/Dn and a volume resistivity of the [carrier 6] measured as the [carrier 1] was are shown in Table 1.

(2) Preparation of Two-Component Developer 6

The procedure for preparation of the [two-component Developer 1] in Example 1 was repeated except for replacing the [carrier 1] with the [carrier 6] to prepare a [two-component developer 6].

(3) Evaluation of the Two-Component Developer 6

The procedure for evaluation of the [two-component developer 1] in Example 1 was repeated except for replacing the [two-component Developer 1] with the [two-component developer 6] to evaluate the [two-component developer 6]. The results are shown in Table 2.

Example 7

(1) Preparation of Carrier 7

(a) Preparation of Binder Resin 4

A slide three-opening flask having a capacity of 500 ml, a three-direction cock, a magnetic stirrer, a Dimroth condenser, a drop funnel having a capacity of 100 ml a septum and a thermometer was deaerated, dried and substituted with argon. 0.62 g (1.67 mmol) of SQA-1 as a polymerization initiating group, 47.5 g (475 mmol) of MMA, 3.25 g (25.0 mmol) of HEMA, 0.08 g (0.83 mmol) of copper chloride (I) and 100 ml of toluene were placed therein, and the solution was subjected to freeze deaeration for 3 times and under an argon stream. The solution was heated to have a temperature of 70° C. in an oil bath while magnetically stirred. After the solution was heated, 0.072 g (0.42 mmol) of PMDETA were added thereto to be reacted therewith at 70° C. for 23.5 hrs. The reaction solution changed to be dark green. After the reaction, 100 ml of toluene and 50 ml of silica gel #60 were added thereto and stirred at room temperature for 24 hrs. Then, the solution changed to be buff yellow. After insoluble matters were filtered under reduced pressure with hyflo super-cel (from NAKALAI TESQUE, INC.), THF was added to the solution to be diluted and have a volume of 11. This THF solution was added to 61 of hexane while strongly stirred, and a colorless solid settled out when reprecipitated. The colorless solid was dried by a decompression dryer until it had a constant mass to prepare a [binder resin 5]. The yield quantity and the yield rate thereof were 26.5 g and 49.9%, respectively. The binder resin had a number-average molecular weight of 22,000, a weight-average molecular weight of 52,000 and a polydispersity of 2.4. The [binder resin 5] had spectra of from 0.60 to 1.00, 1.60 to 2.00, 3.40 to 3.55 and 3.6 to 4.1 when subjected to $^{1}$H-NMR (deurated chloroform, tetramethylsilane internal standard) measurement as the [binder resin 1] was.

(b) Preparation of Carrier 9

The procedure for preparation of the [carrier 1] in Example 1 was repeated except for replacing the [coated layer liquid 1] with a [coated layer liquid 9] having the following formulation to prepare a [carrier 9].

| | |
|---|---|
| Binder resin 4 | 70 |
| Particulate alumina (SUMICORUNDUM AA-04 having a diameter of 0.4 μm from Sumitomo Chemical Co., Ltd.) | 30 |

A weight-average particle diameter (Dw), a number-average particle diameter (Dn), Dw/Dn and a volume resistivity of the [carrier 9] measured as the [carrier 1] were are shown in Table 1.

(2) Preparation of Two-Component Developer 9

The procedure for preparation of the [two-component Developer 1] in Example 1 was repeated except for replacing the [carrier 1] with the [carrier 9] to prepare a [two-component developer 9].

(3) Evaluation of the Two-Component Developer 9

The procedure for evaluation of the [two-component developer 1] in Example 1 was repeated except for replacing the [two-component Developer 1] with the [two-component developer 9] to evaluate the [two-component developer 9]. The results are shown in Table 2.

Example 8

(1) Preparation of Carrier 8

The procedure for preparation of the [carrier 1] in Example 1 was repeated except for replacing the [coated layer liquid 1] with a [coated layer liquid 8] having the following formulation to prepare a [carrier 8].

| | |
|---|---|
| Binder resin 4 | 55 |
| Guanamine solution (MYCOAT 106 including a sold content in an amount of 77% by weight from Mitsui Cytec, Ltd.) | 19.5 |
| Particulate alumina (SUMICORUNDUM AA-04 having a diameter of 0.4 μm from Sumitomo Chemical Co., Ltd.) | 30 |
| Amino silane coupling agent (SH6020 including a solid content in an amount of 100% by weight from Dow Corning Toray Silicone Co., Ltd.) | 0.5 |

A weight-average particle diameter (Dw), a number-average particle diameter (Dn), Dw/Dn and a volume resistivity of the [carrier 8] measured as the [carrier 1] was are shown in Table 1.

(2) Preparation of Two-Component Developer 8

The procedure for preparation of the [two-component Developer 1] in Example 1 was repeated except for replacing the [carrier 1] with the [carrier 8] to prepare a [two-component developer 8].

(3) Evaluation of the Two-Component Developer 8

The procedure for evaluation of the [two-component developer 1] in Example 1 was repeated except for replacing the [two-component Developer 1] with the [two-component developer 8] to evaluate the [two-component developer 8]. The results are shown in Table 2.

Example 9

(1) Preparation of Carrier 9

(a) Preparation of Binder Resin 5

A slide three-opening flask having a capacity of 500 ml, a three-direction cock, a magnetic stirrer, a Dimroth condenser, a drop funnel having a capacity of 100 ml a septum and a thermometer was deaerated, dried and substituted with argon. 1.85 g (5.00 mmol) of SQA-1 as a polymerization initiating group, 25.0 g (250 mmol) of MMA, 0.248 g (2.50 mmol) of copper chloride (I) and 100 ml of toluene were placed therein, and the solution was subjected to freeze deaeration for 3 times and under an argon stream. The solution was heated to have a temperature of 70° C. in an oil bath while magnetically stirred. After the solution was heated, 0.217 g (1.25 mmol) of PMDETA were added thereto to be reacted therewith at 70° C. The reaction solution changed to be dark green. 3.25 g (25.0 mmol) of HEMA were added to the solution with a syringe after 6 hrs had passed since the reaction started, and the solution was further reacted at 70° C. for 3 hrs. Next, 25.0 g (250 mmol) of MMA was added thereto and the solution was further reacted at 70° C. for 18 hrs. After the reaction, 100 ml of toluene and 50 ml of silica gel #60 were added thereto and stirred at room temperature for 24 hrs. Then, the solution changed to be buff yellow. After insoluble matters were filtered under reduced pressure with hyflo super-cel (from NAKALAI TESQUE, INC.), THF was added to the solution to be diluted and have a volume of 11. This THF solution was added to 61 of hexane while strongly stirred, and a colorless solid settled out when reprecipitated. The colorless solid was dried by a decompression dryer until it had a constant mass to prepare a [binder resin 4]. The yield quantity and the yield rate thereof were 28.0 g and 52.7%, respectively. The binder resin had a number-average molecular weight of 79,000, a weight-average molecular weight of 155,000 and a polydispersity of 2.0. The [binder resin 4] had spectra of from 0.70 to 1.00, 1.70 to 2.05, 3.45 to 3.60 and 3.7 to 4.2 when subjected to $^{1}$H-NMR (deurated chloroform, tetramethylsilane internal standard) measurement as the [binder resin 1] was.

(b) Preparation of Carrier 7

The procedure for preparation of the [carrier 1] in Example 1 was repeated except for replacing the [coated layer liquid 1] with a [coated layer liquid 7] having the following formulation to prepare a [carrier 7].

| | |
|---|---|
| Binder resin 4 | 70 |
| Block polyisocyanate (Takenate B-882N including a solid content in an amount of 70% by weight from Mitsui Chemicals, Inc.) | 28.6 |

A weight-average particle diameter (Dw), a number-average particle diameter (Dn), Dw/Dn and a volume resistivity of the [carrier 7] measured as the [carrier 1] was are shown in Table 1.

(2) Preparation of Two-Component Developer 7

The procedure for preparation of the [two-component Developer 1] in Example 1 was repeated except for replacing the [carrier 1] with the [carrier 7] to prepare a [two-component developer 7].

(3) Evaluation of the Two-Component Developer 7

The procedure for evaluation of the [two-component developer 1] in Example 1 was repeated except for replacing the [two-component Developer 1] with the [two-component developer 7] to evaluate the [two-component developer 7]. The results are shown in Table 2.

Example 10

(1) Preparation of Carrier 10

The procedure for preparation of the [carrier1] in Example 1 was repeated except for replacing the [coated layer liquid 1] with a [coated layer liquid 10] having the following formulation to prepare a [carrier 10].

| | |
|---|---|
| Binder resin 5 | 75 |
| Block polyisocyanate (Takenate B-882N including a solid content in an amount of 70% by weight from Mitsui Chemicals, Inc.) | 35.7 |
| Amino silane coupling agent (SH6020 including a solid content in an amount of 100% by weight from Dow Corning Toray Silicone Co., Ltd.) | 0.7 |

A weight-average particle diameter (Dw), a number-average particle diameter (Dn), Dw/Dn and a volume resistivity of the [carrier 10] measured as the [carrier 1] was are shown in Table 1.

(2) Preparation of Two-Component Developer 10

The procedure for preparation of the [two-component Developer 1] in Example 1 was repeated except for replacing the [carrier 1] with the [carrier 10] to prepare a [two-component developer 10].

(3) Evaluation of the Two-Component Developer 10

The procedure for evaluation of the [two-component developer 1] in Example 1 was repeated except for replacing the [two-component Developer 1] with the [two-component developer 10] to evaluate the [two-component developer 10]. The results are shown in Table 2.

Example 11

(1) Preparation of Carrier 11

(a) Preparation of Binder Resin 6

A slide three-opening flask having a capacity of 2,000 ml, a three-direction cock, a magnetic stirrer, a Dimroth condenser, a septum and a thermometer was deaerated, dried and substituted with argon. 10.0 g (27.0 mmol) of SQA-1 as a polymerization initiating group, 123 g (123 mmol) of MMA, 8.44 g (64.9 mmol) of HEMA, 1.34 g (13.5 mmol) of copper chloride (I) and 500 ml of toluene were placed therein, and the solution was subjected to freeze deaeration for 3 times and under an argon stream. The solution was heated to have a temperature of 70° C. in an oil bath while magnetically stirred. After the solution was heated, 1.17 g (6.75 mmol) of SMDETA were added thereto to be reacted therewith at 70° C. for 18 hrs. The reaction solution changed to be dark green. After the reaction, 300 ml of toluene and 150 ml of silica gel #60 were added thereto and stirred at room temperature for 24 hrs. Then, the solution changed to be buff yellow. After insoluble matters were filtered under reduced pressure with hyflo super-cel (from NAKALAI TESQUE, INC.), THF was added to the solution to be diluted and have a volume of 31. This THF solution was added to 181 of hexane while strongly stirred, and a colorless solid settled out when reprecipitated. The colorless solid was dried by a decompression dryer until it had a constant mass to prepare a [binder resin 6]. The yield quantity and the yield rate thereof were 105.4 g and 74.4%, respectively. The binder resin had a number-average molecular weight of 15,000, a weight-average molecular weight of 37,000 and a polydispersity of 2.5. The [binder resin 6] had spectra of from 0.60 to 1.00, 1.60 to 2.00, 3.40 to 3.55 and 3.6 to 4.1 when subjected to $^{1}$H-NMR (deurated chloroform, tetramethylsilane internal standard) measurement as the [binder resin 1] was.

(b) Preparation of Carrier 11

The procedure for preparation of the [carrier 1] in Example 1 was repeated except for replacing the [coated layer liquid 1] with a [coated layer liquid 11] having the following formulation to prepare a [carrier 11].

| | |
|---|---|
| Binder resin 6 | 100 |
| Amino silane coupling agent (SH6020 including a solid content in an amount of 100% by weight from Dow Corning Toray Silicone Co., Ltd.) | 0.8 |
| Block polyisocyanate (Takenate B-882N including a solid content in an amount of 70% by weight from Mitsui Chemicals, Inc.) | 28.6 |

A weight-average particle diameter (Dw), a number-average particle diameter (Dn), Dw/Dn and a volume resistivity of the [carrier 1] measured as the [carrier 1] was are shown in Table 1.

(2) Preparation of Two-Component Developer 11

The procedure for preparation of the [two-component Developer 1] in Example 1 was repeated except for replacing the [carrier 1] with the [carrier 11] to prepare a [two-component developer 9].

(3) Evaluation of the Two-Component Developer 11

The procedure for evaluation of the [two-component developer 1] in Example 1 was repeated except for replacing the [two-component Developer 1] with the [two-component developer 11] to evaluate the [two-component developer 11]. The results are shown in Table 2.

Example 12

(1) Preparation of Carrier 12

The procedure for preparation of the [carrier 1] in Example 1 was repeated except for replacing the [coated layer liquid 1]

with a [coated layer liquid 12] having the following formulation to prepare a [carrier 12].

| | |
|---|---|
| Binder resin 6 | 70 |
| Particulate alumina (SUMICORUNDUM AA-04 having a diameter of 0.4 μm from Sumitomo Chemical Co., Ltd.) | 30 |
| Amino silane coupling agent (SH6020 including a solid content in an amount of 100% by weight from Dow Corning Toray Silicone Co., Ltd.) | 1.2 |

A weight-average particle diameter (Dw), a number-average particle diameter (Dn), Dw/Dn and a volume resistivity of the [carrier 12] measured as the [carrier 1] was are shown in Table 1.

(2) Preparation of Two-Component Developer 12

The procedure for preparation of the [two-component Developer 1] in Example 1 was repeated except for replacing the [carrier 1] with the [carrier 12] to prepare a [two-component developer 12].

(3) Evaluation of the Two-Component Developer 12

The procedure for evaluation of the [two-component developer 1] in Example 1 was repeated except for replacing the [two-component Developer 1] with the [two-component developer 12] to evaluate the [two-component developer 12]. The results are shown in Table 2.

Comparative Example 1

(1) Preparation of Carrier 13

The procedure for preparation of the [carrier 1] in Example 1 was repeated except for replacing the [coated layer liquid 1] with a [coated layer liquid 13] having the following formulation to prepare a [carrier 13].

| | |
|---|---|
| Acrylic resin (copolymer including methylmethacrylate in an amount of 60% by weight, butylacrylate 34% by weight and 2-hydroxyethylacrylate 6% by weight, and having a weight-average molecular weight of 55,000 and a polydispersity of 4.4) | 55 |
| Guanamine solution (MYCOAT 106 including a sold content in an amount of 77% by weight from Mitsui Cytec, Ltd.) | 19.5 |
| Particulate alumina (SUMICORUNDUM AA-04 having a diameter of 0.4 μm from Sumitomo Chemical Co., Ltd.) | 30 |

A weight-average particle diameter (Dw), a number-average particle diameter (Dn), Dw/Dn and a volume resistivity of the [carrier 13] measured as the [carrier 1] was are shown in Table 1.

(2) Preparation of Two-Component Developer 13

The procedure for preparation of the [two-component Developer 1] in Example 1 was repeated except for replacing the [carrier 1] with the [carrier 13] to prepare a [two-component developer 13].

(3) Evaluation of the Two-Component Developer 12

The procedure for evaluation of the [two-component developer 1] in Example 1 was repeated except for replacing the [two-component Developer 1] with the [two-component developer 13] to evaluate the [two-component developer 13]. The results are shown in Table 2.

Comparative Example 2

(1) Preparation of Carrier 14

The procedure for preparation of the [carrier 1] in Example 1 was repeated except for replacing the [coated layer liquid 1] with a [coated layer liquid 14] having the following formulation to prepare a [carrier 14].

| | |
|---|---|
| Silicone resin solution (SR2405 including a solid content in an amount of 50% by weight from Dow Corning Toray Silicone Co., Ltd.) | 140 |
| Amino silane coupling agent (SH6020 including a solid content in an amount of 100% by weight from Dow Corning Toray Silicone Co., Ltd.) | 1.4 |
| Particulate alumina (SUMICORUNDUM AA-04 having a diameter of 0.4 μm from Sumitomo Chemical Co., Ltd.) | 30 |

A weight-average particle diameter (Dw), a number-average particle diameter (Dn), Dw/Dn and a volume resistivity of the [carrier 14] measured as the [carrier 1] was are shown in Table 1.

(2) Preparation of Two-Component Developer 14

The procedure for preparation of the [two-component Developer 1] in Example 1 was repeated except for replacing the [carrier 1] with the [carrier 14] to prepare a [two-component developer 14].

(3) Evaluation of the Two-Component Developer 14

The procedure for evaluation of the [two-component developer 1] in Example 1 was repeated except for replacing the [two-component Developer 1] with the [two-component developer 14] to evaluate the [two-component developer 14]. The results are shown in Table 2.

Comparative Example 3

(1) Preparation of Carrier 15

The procedure for preparation of the [carrier 1] in Example 1 was repeated except for replacing the [coated layer liquid 1] with a [coated layer liquid 15] having the following formulation to prepare a [carrier 15].

| | |
|---|---|
| Acrylic resin (copolymer including methylmethacrylate in an amount of 60% by weight, butylacrylate 34% by weight and 2-hydroxyethylacrylate 6% by weight, and having a weight-average molecular weight of 55,000 and a polydispersity of 4.4) | 20 |
| Guanamine solution (MYCOAT 106 including a sold content in an amount of 77% by weight from Mitsui Cytec, Ltd.) | 13 |
| Silicone resin solution (SR2405 including a solid content in an amount of 50% by weight from Dow Corning Toray Silicone Co., Ltd.) | 80 |

-continued

| | |
|---|---|
| Amino silane coupling agent (SH6020 including a solid content in an amount of 100% by weight from Dow Corning Toray Silicone Co., Ltd.) | 1.2 |
| Particulate alumina (SUMICORUNDUM AA-04 having a diameter of 0.4 μm from Sumitomo Chemical Co., Ltd.) | 30 |

A weight-average particle diameter (Dw), a number-average particle diameter (Dn), Dw/Dn and a volume resistivity of the [carrier 15] measured as the [carrier 1] was are shown in Table 1.

(2) Preparation of Two-Component Developer 15

The procedure for preparation of the [two-component Developer 1] in Example 1 was repeated except for replacing the [carrier 1] with the [carrier 15] to prepare a [two-component developer 15].

(3) Evaluation of the Two-Component Developer 12

The procedure for evaluation of the [two-component developer 1] in Example 1 was repeated except for replacing the [two-component Developer 1] with the [two-component developer 15] to evaluate the [two-component developer 15]. The results are shown in Table 2.

Comparative Example 4

(1) Preparation of Carrier 16

The procedure for preparation of the [carrier 1] in Example 1 was repeated except for replacing the [coated layer liquid 1] with a [coated layer liquid 16] having the following formulation, replacing the toluene with methylethylketone, and changing burning temperature from 180 to 120° C. to prepare a [carrier 16].

| | |
|---|---|
| Silicone graft acrylic resin solution (X-22-8004 including a solid content in an amount of 40% by weight from Shin-Etsu Chemical Co., Ltd.) | 110 |
| Guanamine solution (MYCOAT 106 including a sold content in an amount of 77% by weight from Mitsui Cytec, Ltd.) | 26 |
| Amino silane coupling agent (SH6020 including a solid content in an amount of 100% by weight from Dow Corning Toray Silicone Co., Ltd.) | 1.0 |
| Particulate alumina (SUMICORUNDUM AA-04 having a diameter of 0.4 μm from Sumitomo Chemical Co., Ltd.) | 30 |

A weight-average particle diameter (Dw), a number-average particle diameter (Dn), Dw/Dn and a volume resistivity of the [carrier 16] measured as the [carrier 1] was are shown in Table 1.

(2) Preparation of Two-Component Developer 16

The procedure for preparation of the [two-component Developer 1] in Example 1 was repeated except for replacing the [carrier 1] with the [carrier 16] to prepare a [two-component developer 16].

(3) Evaluation of the Two-Component Developer 12

The procedure for evaluation of the [two-component developer 1] in Example 1 was repeated except for replacing the [two-component Developer 1] with the [two-component developer 16] to evaluate the [two-component developer 16]. The results are shown in Table 2.

TABLE 1

| | Carrier | Dw (μm) | Dn (μm) | Dv/Dn | Volume Resistivity (log Ω · cm) |
|---|---|---|---|---|---|
| Example 1 | 1 | 38.91 | 34.74 | 1.12 | 14.2 |
| Example 2 | 2 | 39.99 | 35.19 | 1.14 | 15.9 |
| Example 3 | 3 | 39.95 | 35.67 | 1.12 | 14.9 |
| Example 4 | 4 | 38.82 | 35.38 | 1.10 | 14.6 |
| Example 5 | 5 | 40.03 | 35.30 | 1.13 | 15.5 |
| Example 6 | 6 | 39.01 | 35.83 | 1.09 | 15.2 |
| Example 7 | 7 | 39.90 | 35.26 | 1.13 | 16.1 |
| Example 8 | 8 | 38.73 | 35.41 | 1.09 | 15.2 |
| Example 9 | 9 | 39.60 | 35.36 | 1.12 | 14.8 |
| Example 10 | 10 | 40.11 | 35.23 | 1.14 | 15.6 |
| Example 11 | 11 | 39.85 | 34.68 | 1.15 | 16.3 |
| Example 12 | 12 | 39.65 | 35.63 | 1.11 | 15.8 |
| Comparative Example 1 | 13 | 40.03 | 35.13 | 1.14 | 15.3 |
| Comparative Example 2 | 14 | 39.88 | 35.33 | 1.13 | 15.8 |
| Comparative Example 3 | 15 | 39.63 | 35.46 | 1.12 | 15.5 |
| Comparative Example 4 | 16 | 39.08 | 34.28 | 1.14 | 15.2 |

TABLE 2

| | TCD | SAL | TS | ID | TSC | BF | OA |
|---|---|---|---|---|---|---|---|
| Example 1 | 1 | ○ | ○ | ○ | ○ | ○ | ○ |
| Example 2 | 2 | ◎ | ○ | ○ | ○ | ○ | ○ |
| Example 3 | 3 | ○ | ○ | ○ | ○ | ○ | ○ |
| Example 4 | 4 | ◎ | ◎ | ○ | ○ | ○ | ◎ |
| Example 5 | 5 | ◎ | ○ | ○ | ○ | ○ | ○ |
| Example 6 | 6 | ○ | ◎ | ◎ | ○ | ○ | ◎ |
| Example 7 | 7 | ○ | ○ | ◎ | ○ | ○ | ○ |
| Example 8 | 8 | ◎ | ○ | ◎ | ○ | ○ | ◎ |
| Example 9 | 9 | ○ | ◎ | ○ | ◎ | ○ | ◎ |
| Example 10 | 10 | ◎ | ○ | ○ | ○ | ○ | ○ |
| Example 11 | 11 | ○ | ◎ | ○ | ○ | ○ | ○ |
| Example 12 | 12 | ◎ | ◎ | ○ | ◎ | ○ | ◎ |
| Comparative Example 1 | 13 | ○ | X | X | Δ | Δ | Δ |
| Comparative Example 2 | 14 | X | ○ | X | X | X | X |
| Comparative Example 3 | 15 | Δ | X | X | X | X | X |
| Comparative Example 4 | 16 | X | Δ | Δ | X | X | X |

*TCD: Two-component developer

Additional modifications and variations of the present invention are possible in light of the above teachings. It is therefore to be understood that within the scope of the appended claims the invention may be practiced other than as specifically described herein.

This document claims priority and contains subject matter related to Japanese Patent Application No. 2008-233831 filed on Sep. 11, 2008, the entire contents of which are herein incorporated by reference.

What is claimed is:

1. A carrier for electrophotographic developer, comprising:

a core material; and a layer comprising a hinder resin, located overlying the core material, wherein the binder resin comprises:

a segment (A) comprising one or more polymerizable vinyl monomers as a structural unit; and a segment (B) comprising at least one of partially cleaved polyhedral oligomeric silsesquioxane having the following formula (1) and a partially cleaved polyhedral oligomeric silsesquioxane having the following formula (2) as a structural unit:

$$(RSiO_{1.5})_n \quad (1)$$

wherein n represents an integer not less than 4; and a substituent R represents a hydrogen atom, a halogen atom, an alkoxy group or an aryloxy group having 1 to 10 carbon atoms, a saturated hydrocarbon group having 1 to 20 carbon atoms, an alkenyl group having 2 to 20 carbon atoms, an aralkyl group having 6 to 20 carbon atoms, an aryl group having 7 to 20 carbon atoms, a hydroxyalkyl group having 1 to 20 carbon atoms, a silicon-containing group having 1 to 10 silicon atoms or their substituted groups; and $$(R^1SiO_{1.5})_n(R^2SiO_2H)_m \quad (2)$$

wherein n and m independently represent an integer not less than 2; and $R^1$ and $R^2$ independently represent a hydrogen atom, a halogen atom, an alkoxy group or an aryloxy group having 1 to 10 carbon atoms, a saturated hydrocarbon group having 1 to 20 carbon atoms, an alkenyl group having 2 to 20 carbon atoms, an aralkyl group having 6 to 20 carbon atoms, an aryl group having 7 to 20 carbon atoms, a hydroxyalkyl group having 1 to 20 carbon atoms, a silicon-containing group having 1 to 10 silicon atoms or their substituted groups.

2. The carrier of claim 1, wherein the binder resin has a polydispersibility not greater than 3.0 determined from a styrene-converted molecular weight distribution measured by using GPC.

3. The carrier of claim 1, wherein the binder resin has a weight-average molecular eight of from 20,000 to 200,000.

4. The carrier of claim 1, wherein the segment (A) is a copolymer of one or more polymerizable vinyl monomers having at least a hydroxyl group.

5. The carrier of claim 1, wherein the segment (A) is an acrylic resin segment crosslinked with an amino resin or isocyanate.

6. The carrier of claim 1, wherein the segment (A) is formed by living radical polymerization with the segment (B) as a polymerization initiator.

7. The carrier of claim 1, wherein the segment (A) is formed of the polymerizable vinyl monomers polymerized by an atom transfer radical polymerization method.

8. The carrier of claim 1, wherein the layer further comprises an aminosilane coupling agent.

9. A two-component developer, comprising the carrier according to claim 1 and a toner.

* * * * *